US008547037B2

(12) United States Patent
Yatsuda et al.

(10) Patent No.: US 8,547,037 B2
(45) Date of Patent: Oct. 1, 2013

(54) LIQUID-COOLED LED LIGHTING DEVICE

(75) Inventors: Yasushi Yatsuda, Tokyo (JP); Yasushi Hiramoto, Tokyo (JP); Mitsuo Yamada, Tokyo (JP); Teruo Koike, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 935 days.

(21) Appl. No.: 12/626,074

(22) Filed: Nov. 25, 2009

(65) Prior Publication Data

US 2010/0134017 A1 Jun. 3, 2010

(30) Foreign Application Priority Data

Nov. 25, 2008 (JP) ..... 2008-299042
May 25, 2009 (JP) ..... 2009-124948
May 25, 2009 (JP) ..... 2009-125409

(51) Int. Cl.
*G05F 1/00* (2006.01)

(52) U.S. Cl.
USPC ..... 315/309; 315/291; 315/209 R; 315/224; 315/225

(58) Field of Classification Search
None
See application file for complete search history.

(56) References Cited

U.S. PATENT DOCUMENTS 8,207,675 B2 * 6/2012 Ito et al. ..... 315/77
2005/0254013 A1 11/2005 Engle et al.
2009/0195159 A1 * 8/2009 Smith ..... 315/33

FOREIGN PATENT DOCUMENTS

JP 2002-299700 A 10/2002
JP 2006-47914 A 2/2006
JP 2007-537490 A 12/2007
JP 2009-129642 A 6/2009

* cited by examiner

*Primary Examiner* — Tuyet Thi Vo
(74) *Attorney, Agent, or Firm* — Kenealy Vaidya LLP

(57) ABSTRACT

A liquid-cooled LED lighting device can be provided in which a temporal increase in the temperature of the tubing and the circulation pump when the LED light sources are turned off is prevented to ensure high reliability. The liquid-cooled LED lighting device can include an LED light source, a liquid cooling system including a heat receiving jacket and a radiator, an LED light source-driving power supply for supplying power to the LED light source, and a liquid cooling system-driving power supply for supplying power to the liquid cooling system. The LED lighting device can include a control unit, such as a timer circuit. The control unit can maintain supply of the power to the liquid cooling system for a predetermined period of time after supply of the power to the LED light source is stopped.

17 Claims, 29 Drawing Sheets

LIQUID-COOLED LED LIGHTING DEVICE

This application claims the priority benefit under 35 U.S.C. §119 of Japanese Patent Applications No. 2008-299042 filed on Nov. 25, 2008, No. 2009-124948 filed on May 25, 2009, and No. 2009-125409 filed on May 25, 2009, which are hereby incorporated in their entirety by reference.

TECHNICAL FIELD

The presently disclosed subject matter relates to an LED lighting device. In particular, the presently disclosed subject matter relates to a liquid-cooled LED lighting device that employs a liquid-cooling system for cooling LED light sources.

BACKGROUND ART

In recent years, high intensity lamps, such as xenon lamps and sodium lamps, used as the light sources of lighting devices such as vehicle headlamps and exterior lighting devices are being replaced with semiconductor light emitting apparatuses (for example, such as LEDs) that have long life and low power consumption. Therefore, there is a demand for higher power LED lighting devices including LEDs as light sources.

Most xenon lamps currently in widespread use have an output power of about 200 W to about 2000 W. Therefore, the power inputted to LED lighting devices that are replacing the xenon lamps is also increasing. Recent development shows that the power inputted to one LED lighting device can be greater than 200 W.

As the power of LED lighting devices increases, the amount of heat generated from the LED light sources increases. Since the light conversion efficiency of the LED light sources is lowered and life thereof is shortened with temperature increases, an important task is to develop a cooling structure for reducing the temperature of the LED light sources to drive them stably. For example, in a cooling structure proposed in Japanese Patent Application Laid-Open No. 2002-299700, an LED-mounted substrate is pressed against and secured to a metal heat dissipating-securing plate by a metal heat dissipating cover, and the heat dissipating-securing plate, which has the LED-mounted substrate secured thereto, is disposed in a sealed space formed by a light-transmitting cover and a resin case. A plurality of heat dissipating fins are formed on the heat dissipating-securing plate. In this structure, the heat generated from the LED light sources is transferred to the heat dissipating-securing plate through the LED-mounted substrate and through the heat dissipating cover. The heat transferred to the heat dissipating-securing plate is dissipated into the atmosphere through the heat dissipating fins and the resin case, and the LED light sources are thereby cooled.

However, with the above natural cooling-heat dissipating structure, a high cooling effect is not expected, and, thus, there is a limit to the increase in the output power.

In view of the above, a liquid cooling system that cools LED light sources by circulating cooling liquid through a closed circulation path is proposed (for example, see Japanese Patent Application Laid-Open No. 2006-047914). This liquid cooling system includes a heat receiving jacket, a radiator, a circulation pump, a reserve tank, and a fan. The cooling liquid is circulated through the circulation path by the circulation pump and receives the heat generated from the LED light sources when passing through the heat receiving jacket. The cooling liquid, increased in temperature due to reception of heat generated from the LED light sources, is then cooled in the radiator by heat exchange with outside air. In this system, the above cycle is repeated to liquid-cool the LED light sources.

Referring to FIGS. 1 to 3, a description will be given of the basic configuration of a liquid-cooled LED lighting device having the above liquid cooling system and its control flow when the device is turned on and off.

FIG. 1 is a block diagram illustrating the basic configuration of the power supply system of the conventional liquid-cooled LED lighting device. An LED on-off switch 127 is connected to a power supply (main power supply) 126 such as a commercial power supply. An LED light source-driving power supply 128 for supplying power to LED light sources 110 and a liquid cooling system-driving power supply 130 for supplying power to a fan and a circulation pump 103 of the cooling system are connected in parallel to the LED on-off switch 127.

FIG. 2 is a flowchart showing the control flow when the liquid-cooled LED lighting device is turned on. As shown in FIG. 2, the main power supply 126 is turned on (step S41) and the LED on-off switch 127 is switched on (step S42). Thereby, the LED light source-driving power supply 128 and the liquid cooling system-driving power supply 130 are simultaneously turned on (steps S43 and S44). Therefore, the LED light sources 110 are turned on (step S45), and the liquid cooling system 103 (including a fan, a pump, and the like) is actuated to cool the LED light sources 110.

FIG. 3 is a flowchart showing the control flow when the liquid-cooled LED lighting device is turned off. As shown in FIG. 3, when the LED on-off switch 127 is switched off (step S51), the LED light source-driving power supply 128 is turned off, and the LED light sources are turned off (step S52). At the same time, the liquid cooling system-driving power supply 130 is turned off, and the fan and the circulation pump of the liquid cooling system 103 are stopped (step S53). Then the entire operation of the liquid cooling LED lighting system is stopped (step S54).

In the conventional liquid-cooled LED lighting device, at the same time as the LED on-off switch 127 is switched off, the liquid cooling system-driving power supply 130 is turned off, and the fan and the circulation pump of the liquid cooling system 103 are stopped, as shown in the flowchart in FIG. 3. Therefore, the efficiency of dissipation of the heat received by the cooling liquid to the outside air is significantly reduced. In addition, since the circulation of the cooling liquid is stopped, the flow of heat to the components connected to the heat receiving jacket and those in the downstream side are interrupted, and this results in thermal insulation.

A general liquid-cooled LED lighting device is required to have heat dissipation performance that ensures that the temperature of the LED light sources is maintained at 150° C. or less. Under normal operation, the temperatures of the heat receiving jacket and the cooling liquid contained therein are midway between the temperature of the LED light sources and the temperature of ambient air. Therefore, assuming that the temperature of outside air is about 20° C., the temperature of the liquid cooling system is about 85° C. at maximum.

Therefore, when, as described above, the heat receiving jacket is thermally insulated because the liquid cooling system is stopped at the same time as the LED light sources are turned off, the heat accumulated in the LED light sources and the heat receiving jacket is not dissipated from the radiator. Although the temperature of the LED light sources does not increase, the temperature of the heat receiving jacket and the cooling liquid therein temporarily increases. This heat is transferred through the liquid in tubing, resulting in an increase in the temperature of other components such as the circulation pump and rubber hoses.

Table 1 shows the results of the measurement of the temperatures of the components (LED light sources, heat receiving jacket, circulation pump, and radiator) of the conventional liquid-cooled LED lighting device when the device is ON and just after the device is turned off (outside air temperature: 25° C.).

TABLE 1

| | When device is ON | Just after device is turned off |
|---|---|---|
| LED light sources | 150° C. | 130° C. |
| Heat receiving jacket | 85° C. | 110° C. |
| Circulation pump | 60° C. | 80° C. |
| Radiator | 45° C. | 45° C. |
| Outside air | 25° C. | 25° C. |

For example, the temperature of the rubber hoses temporarily increases to about 110° C., which is higher than their heat resistant temperature. This causes a reduction in the reliability of the device. As the temperature of the cooling liquid increases, its volume increases. Therefore, the volume of the cooling liquid passing through the rubber hoses increases. This causes a problem in that the size of the reserve tank should be increased.

The life of the circulation pump is known to be largely affected by temperature. As described above, when the LED light sources are turned off and at the same time the liquid cooling system is stopped, the temperature of the circulation pump temporarily increases to about 100° C. This also causes a reduction in the reliability of the device.

Furthermore, in the LED lighting device with the above configuration, the temperature of the cooling liquid depends on the temperature of ambient air, assuming that the heat dissipation performance of the lighting device is not varied. In this case, as the temperature of the ambient air increases, the temperature of the cooling liquid is also increased, resulting in the increase of the LED temperature when the LEDs are turned on. As a result, the light conversion efficiency may deteriorate, and accordingly, the illumination intensity may also deteriorate. At the same time, the life of the LED device is also shortened.

In addition to the temperature change of ambient air, several causes that can lower the heat dissipation performance over time may be involved. Examples of the causes include variations in the flow rate of the pump, the rate at which the fans blows air, and the LLC concentration of the cooling liquid, etc. Accordingly, the liquid-cooling system is likely to be affected by temperature changes during operation of the LED as compared with heat dissipation caused by a heat dissipation structure utilizing an air cooling mechanism (such as a heat sink) with natural heat dissipation. This system poses a problem in that a stable illumination intensity and life cannot be ensured.

Furthermore, if the circular pump and/or the fan do not properly operate due to unexpected external causes, breaking of the power supplying wire, and/or the expiration of its useful life, heat generated by the LEDs cannot be transferred from the heat receiving jacket to the downstream components. This means that the entire temperature of the components of the heat dissipation structure, including LEDs increases. In some worst cases, the temperature of cooling liquid may exceed its boiling point, which may cause the tubing to be broken, leading to liquid leakage.

Lighting devices for use in dangerous areas such as chemical plants, mine cavities, areas where dangerous objects should be handled, gas stations, oil storages, manholes, tunnels, factories for fireworks production, ammunition dumps, and the like generally use, as their light source, metal halide lamps, high-pressure mercury lamps, halogen lamps, and other discharge type light source lamps. Such lighting devices have been provided with various countermeasures for preventing surrounding flammable gases from catching fire. For example, in Japanese Patent Publication No. 4099603 (B), an explosion protection lighting device has been proposed, in which socket holders are disposed at respective ends of a main body, and a straight-tube lamp is disposed between the socket holders while the lamp is enclosed within a lamp protection cylinder.

However, it is difficult for a conventional lighting device that utilizes a discharge type light source lamp to completely prevent the occurrence of explosions caused by a lamp burst. Accordingly, in order to lower the risk of explosion as much as possible, several explosion-protection structures have been developed, but these have not provided sufficient protection.

Furthermore, such a structure may require a thick glass member that has an increased strength for the discharge type light source lamp, and may employ complex connecting structures for components to enhance the hermeticity. These structures may have a disadvantageously increased weight or volume caused by the used lamp.

Furthermore, since the discharge type light source lamp should be periodically replaced with a new one, there is a problem because maintenance, such as replacement of the lamp, may take a large amount of time and labor due to the complex structures, as described above.

The presently disclosed subject matter was devised in view of these and other problems and in association with the conventional art. According to an aspect of the presently disclosed subject matter, a liquid-cooled LED lighting device can be provided in which a temporal increase in the temperature of the tubing and the circulation pump when the LED light sources are turned off is prevented to ensure high reliability.

According to another aspect of the presently disclosed subject matter, the liquid-cooled LED lighting device can suppress excess temperature increases when the LED light sources are turned off to maintain a stable state, thereby achieving stable output illumination intensity and life. Furthermore, the liquid-cooled LED lighting device can ensure the safety of the device, including the LED light sources by interrupting the drive current if the temperature of the cooling liquid abnormally increases.

According to still another aspect of the presently disclosed subject matter, the liquid-cooled LED lighting device can be used in a dangerous area while the device can prevent possible explosion risks and also facilitate the maintenance thereof.

According to still another aspect of the presently disclosed subject matter, a liquid-cooled LED lighting device can include: an LED light source, a liquid cooling system including a heat receiving jacket and a radiator, an LED light source-driving power supply configured to supply power to the LED light source, a liquid cooling system-driving power supply configured to supply power to the liquid cooling system, and a control unit configured to control at least one of the LED light source-driving power supply and the liquid cooling system-driving power supply.

In the liquid-cooled LED lighting device as configured above, the control unit can control and maintain the supply of power from the liquid cooling system-driving power supply to the liquid cooling system for a predetermined period of time after supply of the power from the LED light source-driving power supply to the LED light source is stopped.

The liquid-cooled LED lighting device as configured above can further include an LED on-off switch configured to transmit an ON signal and an OFF signal to the control unit, and the control unit can include a timer circuit configured to be activated in response to the OFF signal transmitted from the LED on-off switch. In this configuration, the control unit can maintain the supply of the power from the liquid cooling system-driving power supply to the liquid cooling system for the predetermined time in response to an output signal from the timer circuit.

In the liquid-cooled LED lighting device as configured above, the control unit can include a temperature control circuit including a temperature detection element that is secured to one of the LED light source, the heat receiving jacket, and a metal base in contact with the heat receiving jacket. In this configuration, the control unit can maintain the supply of the power from the liquid cooling system-driving power supply to the liquid cooling system for a period of time in response to an output signal from the temperature control circuit.

In the liquid-cooled LED lighting device as configured above, when a temperature detected by the temperature detection element after the supply of the power from the LED light source-driving power supply to the LED light source is stopped is higher than a first predetermined threshold value, the control unit can maintain the supply of the power from the liquid cooling system-driving power supply to the liquid cooling system until the temperature detected by the temperature detection element is equal to or lower than the first predetermined threshold value.

In the liquid-cooled LED lighting device as configured above, if a temperature detected by the temperature detection element at a time when the supply of the power from the LED light source-driving power supply to the LED light source is started is lower than a second predetermined threshold value, the control unit can prevent the supply of the power from the liquid cooling system-driving power supply to the liquid cooling system until the temperature detected by the temperature detection element is equal to or higher than the second predetermined threshold value.

Alternatively, in the liquid-cooled LED lighting device configured to include the basic components as above, the control unit can include a temperature control circuit including a temperature detection element that is secured to one of the LED light source, the heat receiving jacket, and a metal base in contact with the heat receiving jacket. In this configuration, the control unit can control a drive current for the LED light source based on a temperature detected by the temperature detection element. Furthermore, the control unit can control the drive current for the LED light source to be within a range of from zero (0) to a normal LED drive current.

Still alternatively, the liquid-cooled LED lighting device configured to include the basic components as above can be used to illuminate an area where a flammable gas having a flash point is present. In this liquid-cooled LED lighting device, the temperature detection element can be secured to the LED light source to detect a temperature of the LED light source, and the control unit can control at least one of the LED light source-driving power supply and the liquid cooling system-driving power supply to maintain the temperature of the LED light source to be lower than the flash point of the flammable gas. In this case, the control unit can control the temperature of the LED light source so that the highest temperature of the LED light source at its emission portion is equal to or lower than 95° C.

In the liquid-cooled LED lighting device as configured above, the temperature detection element can be any of a thermistor and a temperature detection IC.

The liquid-cooled LED lighting device as configured above can further include a pilot lamp configured to be turned on when the liquid cooling system is stopped by interruption of the supply of the power from liquid cooling system-driving power supply to the liquid cooling system.

The liquid-cooled LED lighting device as configured above can further include an air cooling heat dissipation system. In this case, the heat receiving jacket can be disposed between the LED light source and the air cooling heat dissipation system.

The liquid-cooled LED lighting device as configured above can further include a metal circuit casing configured to cover the control unit for controlling the drive of the LED light source, the LED light source-driving power supply, and the like. In this case, the circuit casing can include an atmospheric heat dissipation portion. Furthermore, the circuit casing can be disposed so as to be in close contact with the heat receiving jacket. Then, the atmospheric heat dissipation portion formed in the circuit casing can serve as the air cooling heat dissipation system.

Alternatively, the heat receiving jacket can be provided with an atmospheric heat dissipation portion. In this case, the atmospheric heat dissipation portion formed in the heat receiving jacket can serve as the air cooling heat dissipation system.

In the liquid-cooled LED lighting device as configured above, the atmospheric heat dissipation portion can be composed of a heat dissipation pin and/or a heat dissipation fin.

In the liquid-cooled LED lighting device including the air cooling heat dissipation system as configured above, if the liquid cooling system does not work properly, the control unit can control the LED light source-driving power supply so that the detected temperature of the LED light source can be maintained lower than the flash point of the flammable gas through only the air cooling heat dissipation system. In this case, the control unit can control the current to be supplied to the LED light source to a value such that heat generated by the LED can be absorbed by the air cooling heat dissipation system.

Furthermore, in the liquid-cooled LED lighting device as configured above, the liquid cooling system can further include a circulation pump, a reserve tank, and a fan.

According to one aspect of the presently disclosed subject matter, the liquid-cooled LED lighting device as configured above can include a control unit configured to control at least one of the LED light source-driving power supply and the liquid cooling system-driving power supply. This configuration can provide an appropriate cooling effect by controlling the system in various ways. For example, even after the supply of the power from the LED light source-driving power supply to the LED light source is stopped and the LED light source is turned off, the supply of the power from the liquid cooling system-driving power supply to the liquid cooling system is controlled to be maintained for a predetermined period of time so that the fan and the circulation pump can remain energized. Therefore, a temporal increase in the temperature of the tubing such as rubber hoses and the circulation pump can be prevented, and the reliability of the liquid-cooled LED lighting device can be improved.

Furthermore, in the liquid-cooled LED lighting device as configured above, even after the LED light source is turned off, the fan and the circulation pump of the liquid cooling system can remain activated for a period of time set by the timer circuit. Therefore, a temporal increase in the temperature of the tubing such as the rubber hoses and the circulation pump is prevented, and this ensures high reliability of the liquid-cooled LED lighting device.

In the liquid-cooled LED lighting device as configured above, when the temperature detected by the temperature detection element after the LED light source is turned off is or higher than a predetermined threshold value, the supply of the power to the liquid cooling system is maintained until the temperature detected by the temperature detection element is equal to or lower than the predetermined threshold value. Since the fan and the circulation pump remain energized during this period, the tubing such as the rubber hoses and the circulation pump can be cooled to a preset temperature in a reliable manner.

In the liquid-cooled LED lighting device as configured above, under cool conditions in which the temperature detected by the temperature detection element when the LED light source is turned on is lower than a predetermined threshold value, the power is not supplied to the liquid cooling system until the temperature detected by the temperature detection element is equal to or higher than the predetermined threshold value. Since cooling is not effected during this period, the entire liquid-cooled LED lighting device can be rapidly warmed to the required operating temperature.

In the liquid-cooled LED lighting device as configured above, the control unit can be provided with a temperature detection element, and can control the drive current for the LED light source based on a temperature detected by the temperature detection element. In this case, the LED drive current can be controlled within a range of from zero to a normal LED drive current. This control can suppress the excessive temperature increase when the LED light source is driven. As a result, the lighting device can utilize a higher power LED light source and ensure the stable illumination intensity and life as well as the high reliability of the device.

When the liquid-cooled LED lighting device is used in the area where a flammable gas with a certain flash point is present, the liquid-cooled LED lighting device can have a liquid cooling system disposed adjacent to the light source portion, including LEDs, and can control at least one of the LED light source-driving power supply and the liquid cooling system-driving power supply to maintain the temperature of the LED light source (the highest temperature of the LED light source at its emission portion) to be lower than the flash point of the flammable gas (for example, equal to or lower than 95° C.). Accordingly, even when the liquid-cooled LED lighting device of the presently disclosed subject matter is used in a dangerous area, it is possible to prevent possible explosion risks due to catching fire of the surrounding flammable gas.

The liquid-cooled LED lighting device of the presently disclosed subject matter utilizes as its light source an LED(s) that is substantially maintenance free. Accordingly, the replacement of light sources can be eliminated, thereby facilitating the maintenance thereof.

In the liquid-cooled LED lighting device as configured above, the temperature of any of the LED light source, the heat receiving jacket, and the metal base in contact with the heat receiving jacket is correctly detected by the thermistor or the temperature detection IC, and the liquid cooling system can thereby be appropriately controlled.

In the liquid-cooled LED lighting device as configured above, the liquid cooling system can remain energized for a predetermined time after the LED light source is turned off. Subsequently, when the supply of the power to the liquid cooling system is stopped and the liquid cooling system is stopped, the pilot lamp is turned on to indicate this condition. Therefore, a main power source switch can be switched off after the state of the pilot lamp is checked.

In the liquid-cooled LED lighting device as configured above, when the liquid cooling system, having operating portions such as a circulation pump and a fan, cannot work properly due to some accidents (namely, the cooling function is damaged), the control unit can control the current to be supplied to the LED light source to a value such that heat generated by the LED can be absorbed by the air cooling heat dissipation system. Accordingly, overheating of the LED can be prevented. In this case, although the illumination intensity may be lowered due to the suppressed current, the maximum temperature of the light source can be controlled to be lower than the flash point of the surrounding flammable gas. Thus, even when the liquid-cooled LED lighting device of the presently disclosed subject matter is used in a dangerous area, it is possible to prevent possible explosion risks.

BRIEF DESCRIPTION OF DRAWINGS

These and other characteristics, features, and advantages of the presently disclosed subject matter will become clear from the following description with reference to the accompanying drawings, wherein:

FIG. 2 is a flowchart showing the control flow when the conventional liquid-cooled LED lighting device of FIG. 1 is turned on;

FIG. 11 is a flowchart showing the control flow when the liquid-cooled LED lighting device according to an exemplary embodiment of the presently disclosed subject matter is turned on;

FIG. 19 is a flowchart showing the control flow when the liquid-cooled LED lighting device according to an exemplary embodiment of the presently disclosed subject matter is turned on;

DESCRIPTION OF EXEMPLARY EMBODIMENTS

A description will now be made below to liquid-cooled LED lighting devices according to the presently disclosed subject matter with reference to the accompanying drawings in accordance with exemplary embodiments. In the description of the subject application with reference to FIGS. 4 to 22, irrespective of the posture of the illustrated lighting device, the light emission direction may be referred to as "front (front surface side)," and the opposite direction may be referred to as "rear (rear surface side)."

First, the basic configuration of a liquid-cooled LED lighting device made in accordance with principles of the presently disclosed subject matter will be described with reference to FIGS. 4 to 7.

Figure 1:
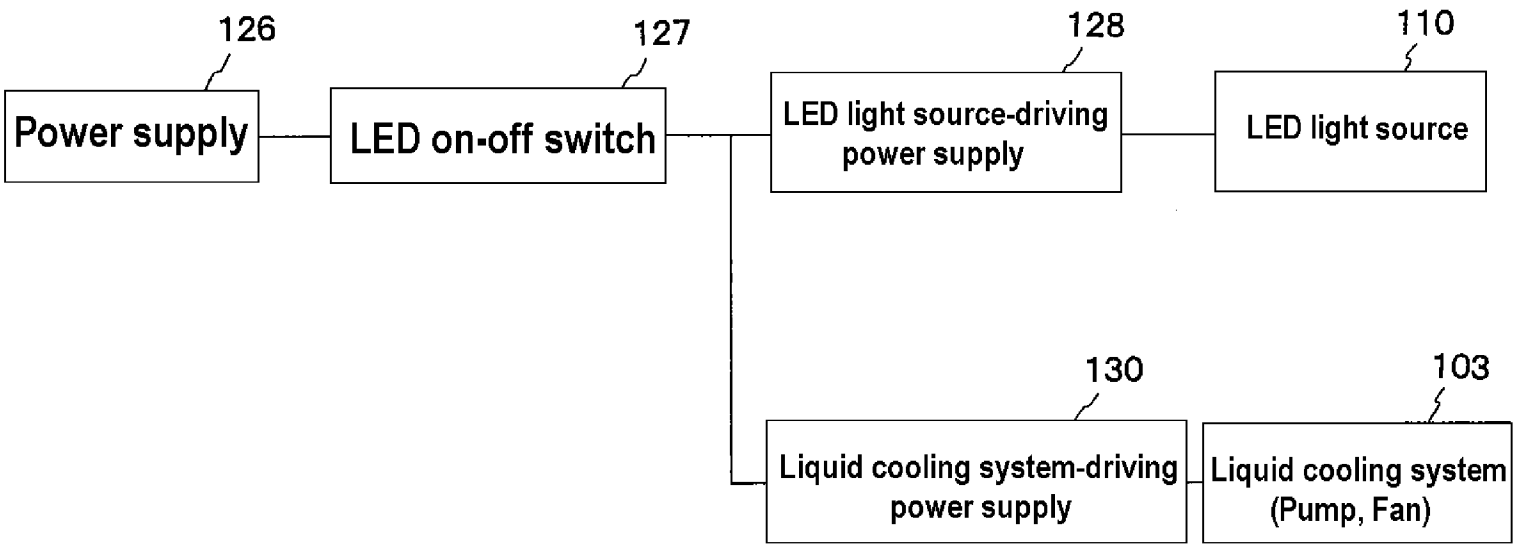
Fig. 1 Conventional Art
FIG. 1 is a block diagram illustrating the basic configuration of a power supply system of a conventional liquid-cooled LED lighting device.
Figure 2:
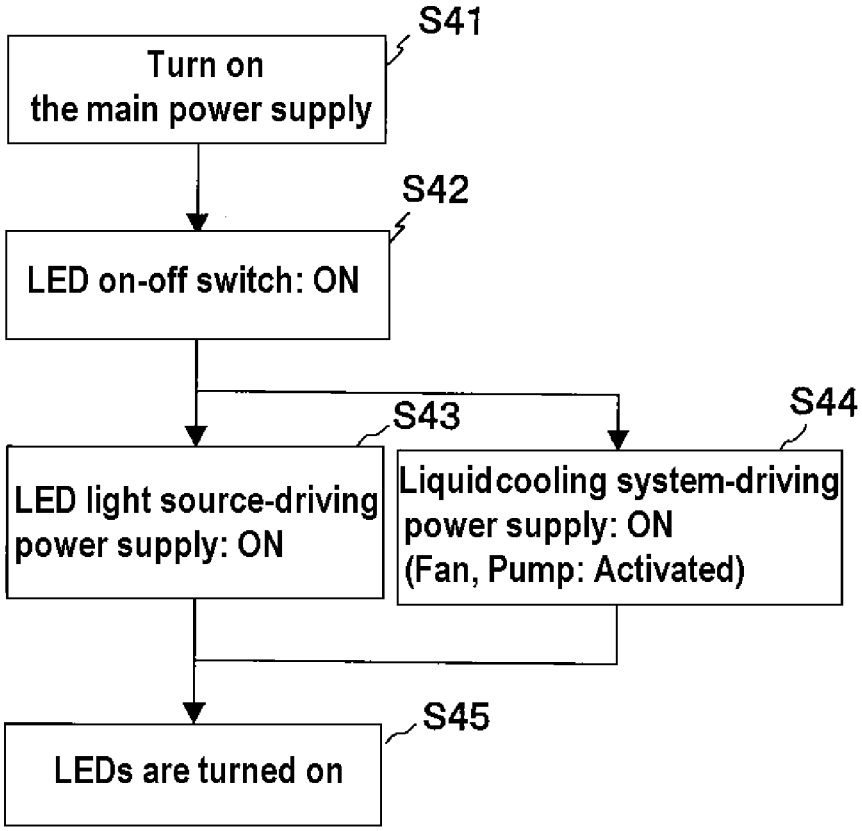
Fig. 2 Conventional Art
Figure 3:
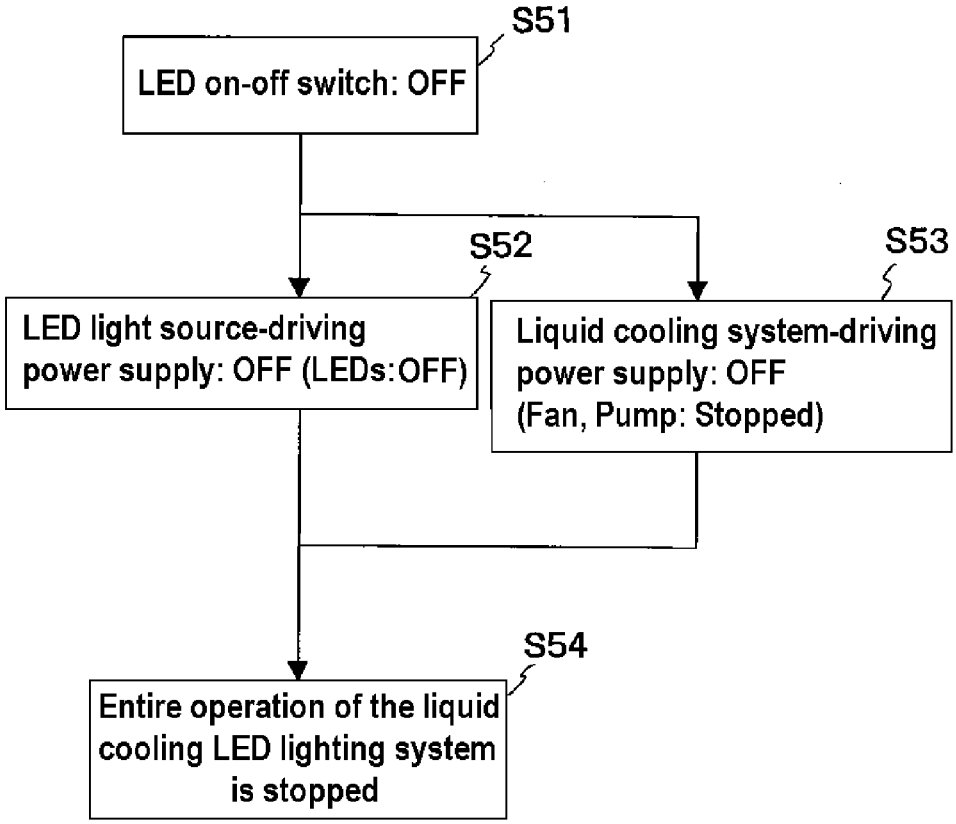
Fig. 3 Conventional Art
FIG. 3 is a flowchart showing the control flow when the conventional liquid-cooled LED lighting device of FIG. 1 is turned off.
Figure 4:
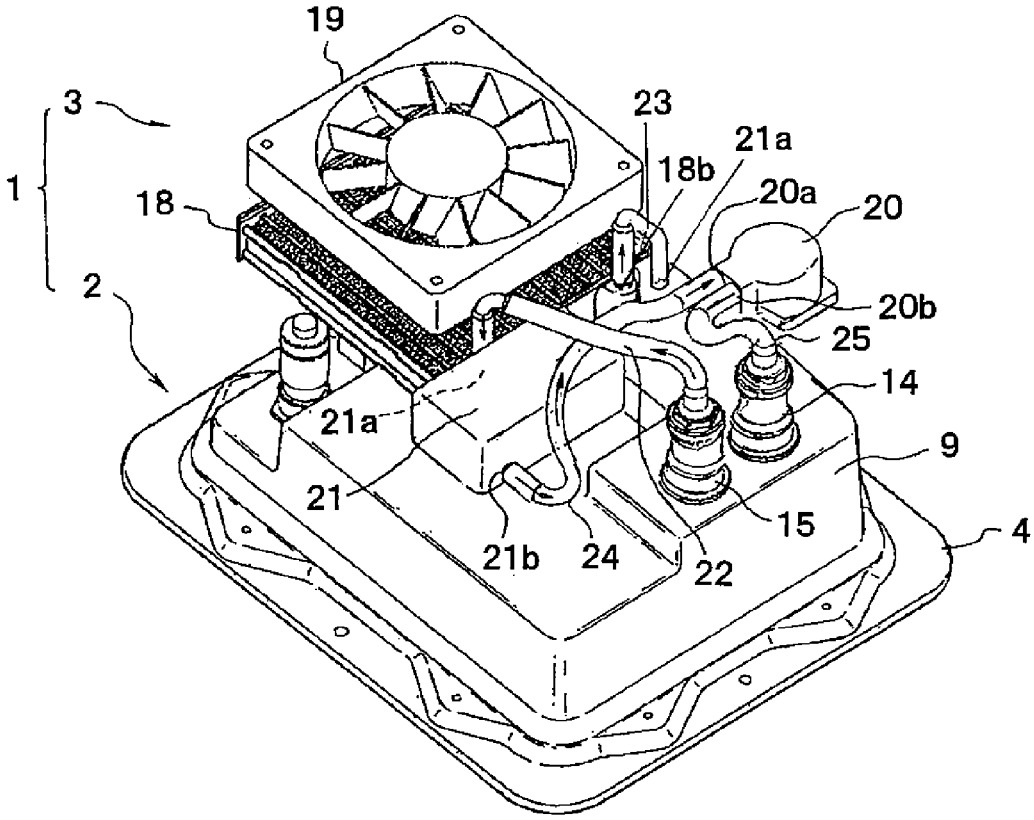
FIG. 4 is a perspective view illustrating the internal structure of a liquid-cooled LED lighting device made in accordance with principles of the presently disclosed subject matter.
Figure 5:
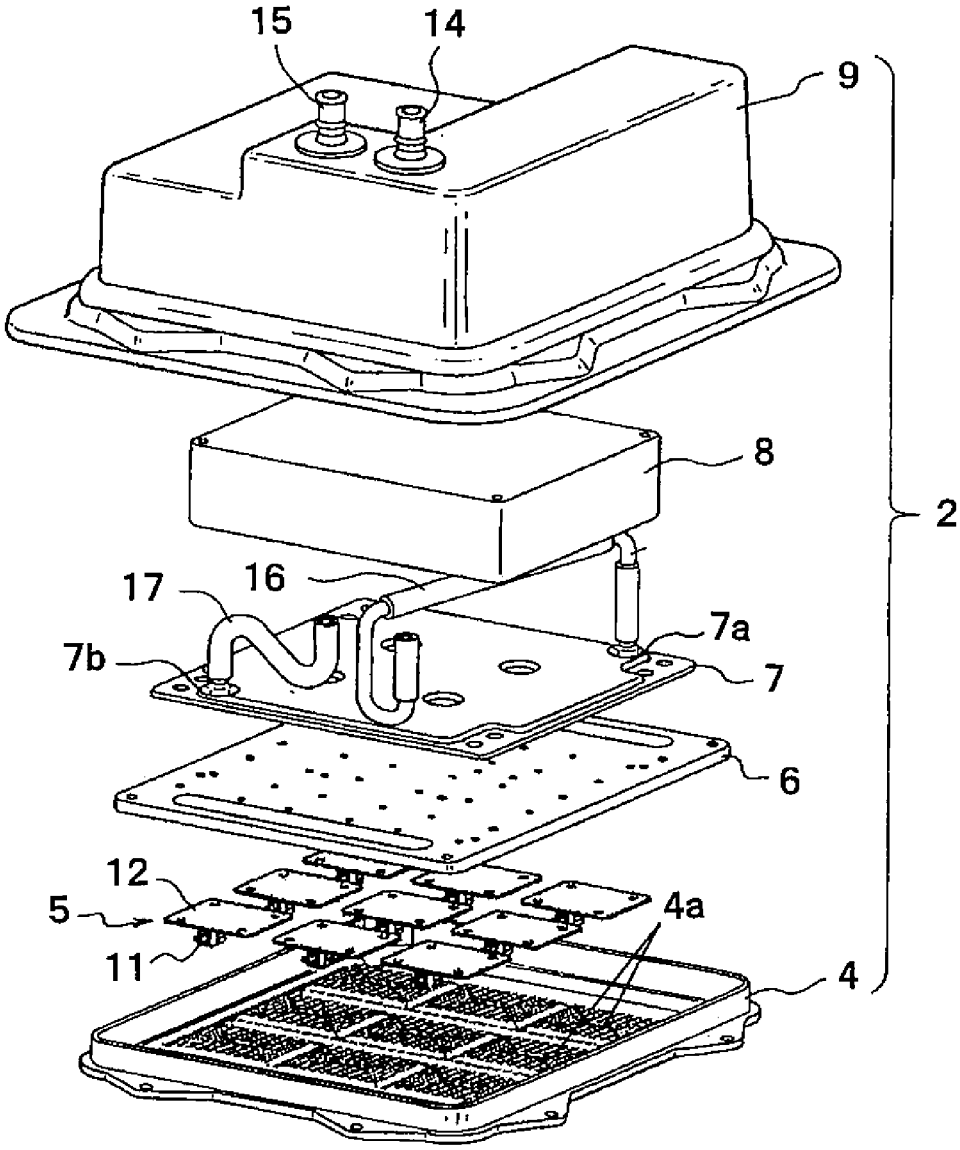
FIG. 5 is an exploded perspective view of a device body of the liquid-cooled LED lighting device of the presently disclosed subject matter.
Figure 6:
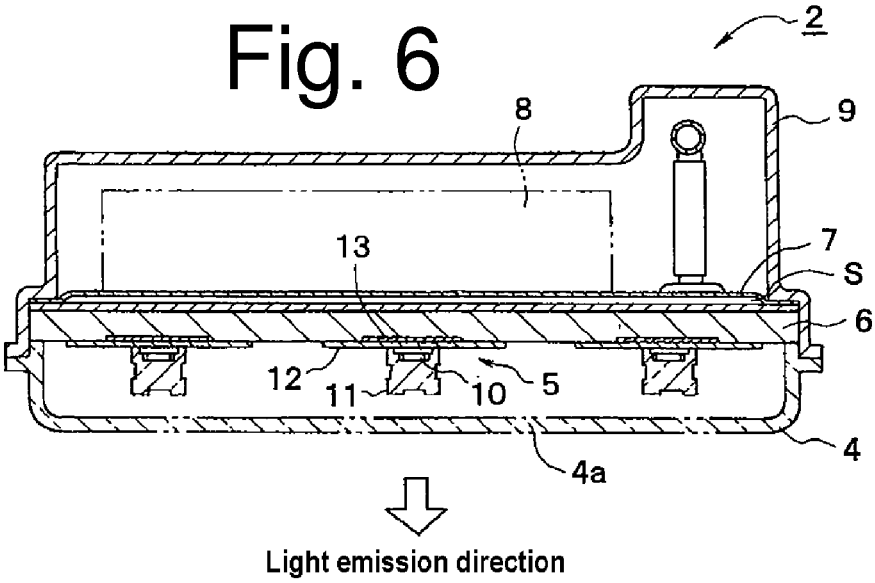
FIG. 6 is a cross-sectional view of the device body of the liquid-cooled LED lighting device of the presently disclosed subject matter.
Figure 7:
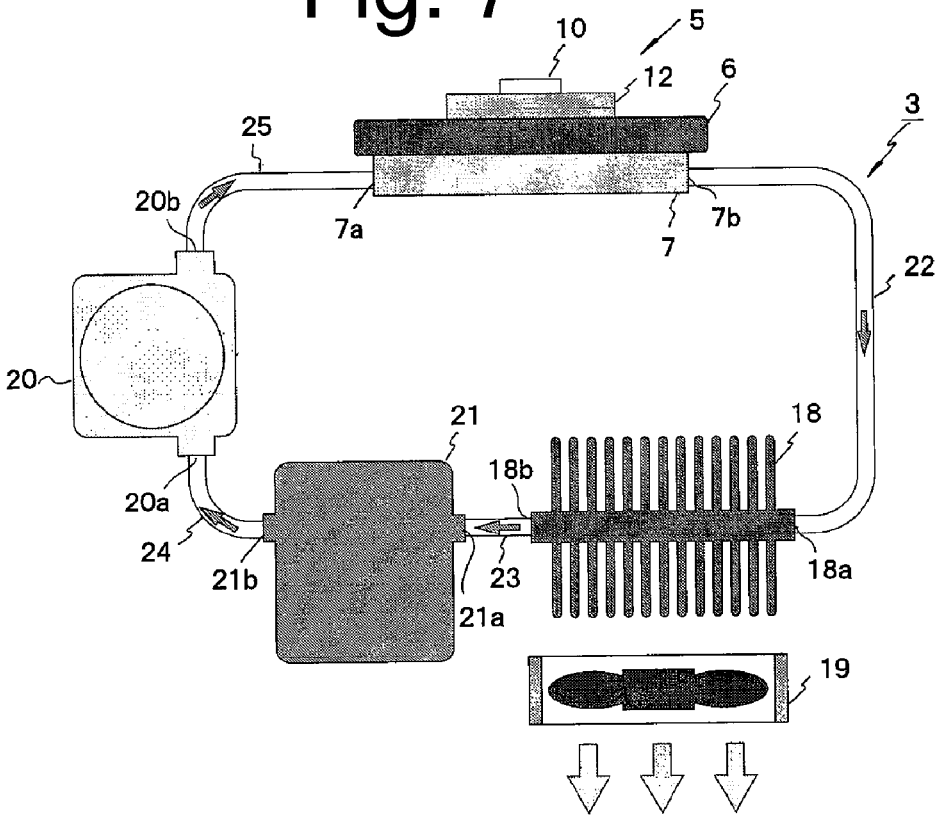
FIG. 7 is a diagram illustrating a liquid cooling system for the liquid-cooled LED lighting device of the presently disclosed subject matter.

FIG. 4 is a perspective view illustrating the internal structure of the liquid-cooled LED lighting device according to the presently disclosed subject matter. FIG. 5 is an exploded perspective view of a device body of the liquid-cooled LED lighting device. FIG. 6 is a cross-sectional view of the device body. FIG. 7 is a diagram illustrating the basic configuration of a liquid cooling system of the liquid-cooled LED lighting device.

As shown in FIG. 4, the liquid-cooled LED lighting device 1 of the presently disclosed subject matter can include a liquid cooling system 3 installed in a device body 2, and all the components can be covered with a resin cover (not shown).

A description of the configuration of the device body 2 will be given with reference to FIGS. 5 and 6. The device body 2 can include a cover lens 4, LED light source modules 5, a metal base 6, a heat receiving jacket 7, a driving circuit box 8, and a housing 9, and these components may be disposed in that order in a direction (the upward direction in the figures) opposite to the direction of light emission. A space can be defined by the cover lens 4 and the housing 9. The LED light source modules 5, the metal base 6, the heat receiving jacket 7, and the driving circuit box 8 can be contained in this space.

The number of the LED light source modules 5 is, for example, nine (9) in this exemplary embodiment. In each LED light source module 5, an LED light source 10 and a connector 11 can be mounted on a substrate 12. As shown in FIG. 6, each LED light source module 5 can be attached to the metal base 6 formed of a high-thermal conductivity metal such as copper or aluminum through an insulating heat conduction sheet 13.

The LED light source may be a white LED that is fabricated by mounting an LED chip on a substrate made of ceramic or copper that has a high heat conductivity and resin-sealing the chip and the like with a sealing resin containing a phosphor material. This configuration can lower the heat resistance. Appropriate combinations of the wavelength of light emitted from the LED chip and the type of the phosphor material can generate various colors of light other than white light.

The substrate on which the LED light sources are mounted can be formed of a rigid substrate or a flexible substrate. Examples of rigid substrate material include materials having a favorable heat conductivity such as metal materials, including copper, aluminum, and the like and ceramic materials. Examples of flexible substrates include polyimides and the like.

As shown in FIG. 5, the nine LED light source modules 5 can be arranged in a 3×3 matrix form. The cover lens 4 can have lens-cut portions 4*a* formed at positions corresponding to the positions of the LED light source modules 5, respectively.

The heat receiving jacket 7 can be attached to the metal base 6 on the rear surface (the side opposite to the surface on which the LED light source modules 5 are mounted). Here, the metal base 6 and the heat receiving jacket 7 can be in surface contact with each other. The heat receiving jacket 7 can be formed to have a hollow rectangular plate shape. As shown in the cross sectional view of FIG. 6, a hollow portion S serving as a passage for a cooling liquid (non-freezing fluid) can be formed inside the heat receiving jacket 7. The heat receiving jacket 7 can also include an inlet port 7*a* through which the cooling liquid cooled by heat exchange with outside air flows, and a discharge port 7*b* from which the cooling liquid that has received heat from the heat receiving jacket 7 is discharged (see FIG. 5). It should be noted that the cooling liquid (cooling medium) may be a mixture of LLC and water in a predetermined ratio.

The driving circuit box 8 can be attached to the heat receiving jacket 7 on the rear surface (on the side opposite to the surface to which the metal base plate 6 is attached). Although not shown in the drawings, the driving circuit box 8 can contain therein electronic and circuit components including a constant current power supply circuit for driving the LED light sources 10.

As shown in FIG. 5, tube connection joints 14 and 15 are attached to the housing 9. A tube (rubber hose) 16 connected to the inlet port 7*a* of the heat receiving jacket 7 is connected to the joint 14, and another tube (rubber hose) 17 connected to the discharge port 7*b* of the heat receiving jacket 7 is connected to the joint 15.

Next, a description will be given of the configuration of the liquid cooling system 3 with reference to FIGS. 4 and 7.

The liquid cooling system 3 can include the heat receiving jacket 7 serving as a heat exchanger, a radiator 18 in which the cooling liquid that increased in temperature due to reception of heat from the heat receiving jacket 7 is cooled by heat exchange with outside air, a fan 19 that supplies cooling wind to the radiator 18, a circulation pump 20 that circulates the cooling liquid through a closed loop, and a reserve tank 21 that stores the cooling liquid. The fan 19 can be disposed so as to face the radiator 18.

As shown in FIG. 5, a tube (rubber hose) 22 extending from the joint 15 connected to the discharge port 7*b* of the heat receiving jacket 7 through the tube 17 can be connected to an inlet port 18*a* of the radiator 18. A tube (rubber hose) 23 extending from a discharge port 18*b* of the radiator 18 can be connected to an inlet port 21*a* of the reserve tank 21. A tube (rubber hose) 24 extending from a discharge port 21*b* of the reserve tank 21 can be connected to an inlet port 20*a* of the circulation pump 20. A tube (rubber hose) 25 extending from a discharge port 20*b* of the circulation pump 20 can be connected to the joint 14 that is connected to the inlet port 7*a* of the heat receiving jacket 7 through the tube 16. As described above, the heat receiving jacket 7, the radiator 18, the reserve tank 21, and the circulation pump 20 can be connected through the tubes 22 to 25 (16 and 17), so that a closed circulation path is formed. The required cooling effect can be achieved by circulation of the cooling liquid through the circulation path.

With reference to FIG. 7 again, the cooling liquid circulating through the circulation path by means of the circulation pump 20 can receive the heat generated by the LED light sources 10 when passing through the heat receiving jacket 7, and the LED light sources 10 are thereby cooled. The cooling liquid, increased in temperature due to reception of the heat, can be introduced into the radiator 18 through the tube 22. In the radiator 18, the heat of the cooling liquid can be dissipated to the outside through the cooling wind supplied from the fan 19, and the cooling liquid can be thereby cooled. The cooling liquid, now decreased in temperature, can be stored in the reserve tank 21 through the tube 23 and can be then sent from the reserve tank 21 to the circulation pump 20 through the tube 24. The cooling liquid can be pressurized in the circulation pump 20 and then introduced into the heat receiving jacket 7 through the tube 25 to cool the LED light sources 10. The above action (cooling cycle) can be continuously repeated to cool the LED light sources 10, so that their temperature rise is suppressed.

Figure 8:
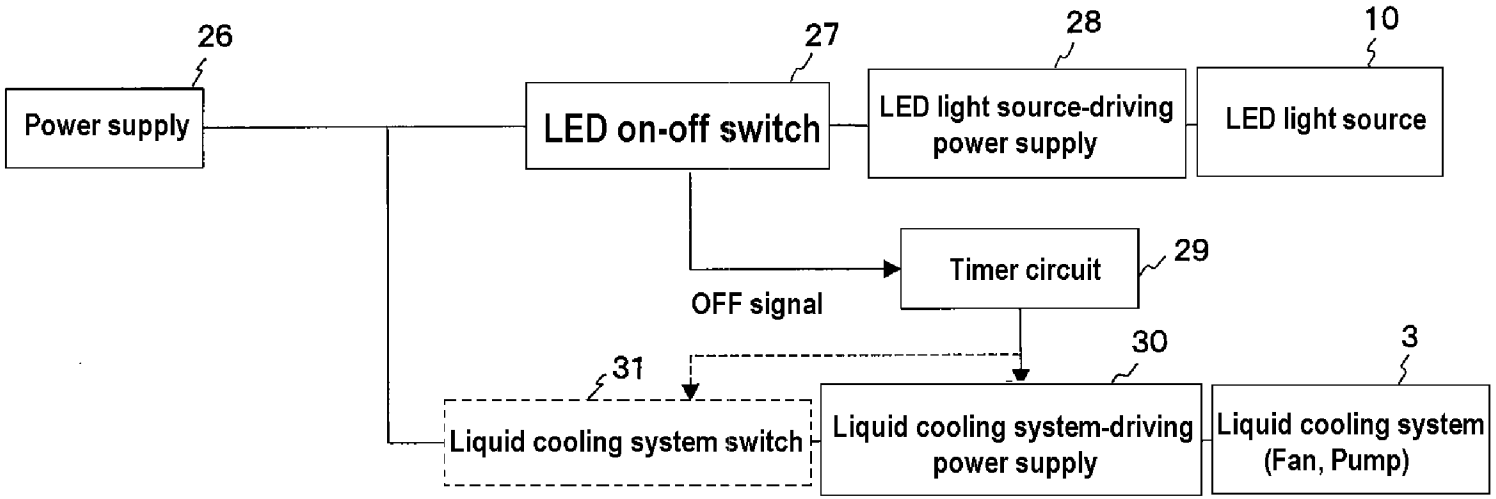
FIG. 8 is a block diagram illustrating a power supply system for a liquid-cooled LED lighting device according to an exemplary embodiment of the presently disclosed subject matter.

FIG. 8 is a block diagram illustrating the basic configuration of a power supply system of a liquid-cooled LED lighting device according to one exemplary embodiment of the presently disclosed subject matter. As shown in FIG. 8, an LED on-off switch 27 can be connected to a power supply (main power supply) 26 such as a commercial power supply. An LED light source-driving power supply 28 for supplying power to the LED light sources 10 and a timer circuit 29 that can be activated in response to a signal from the LED on-off switch 27 can be connected to the LED on-off switch 27.

Figure 9:
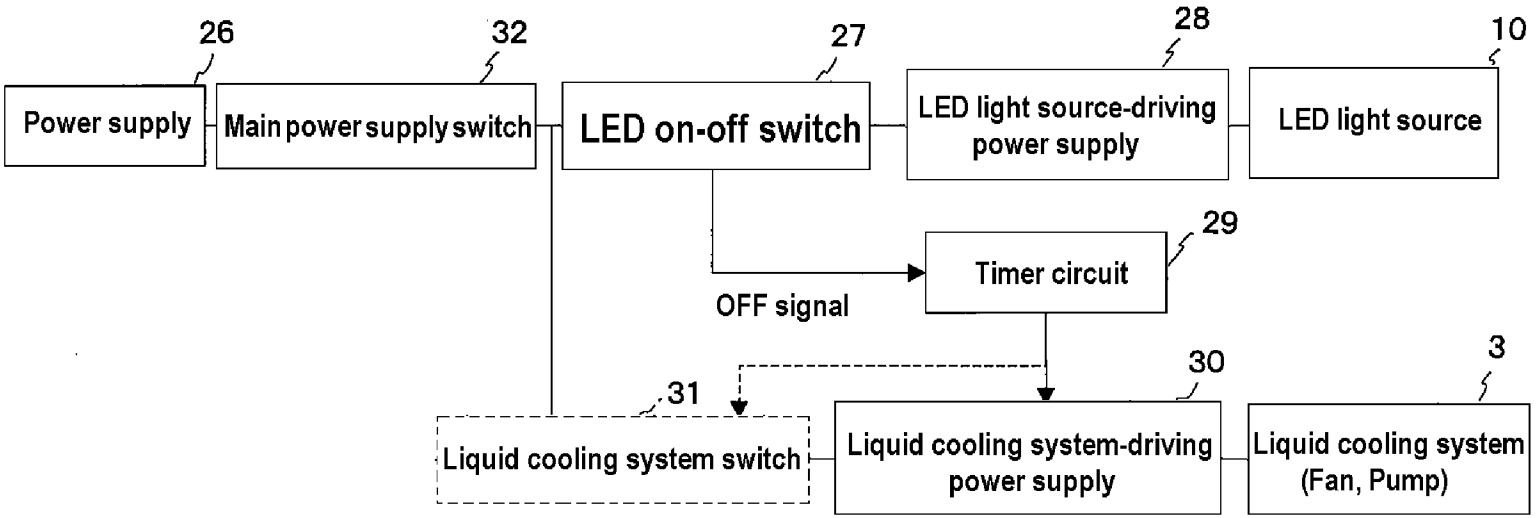
FIG. 9 is a block diagram illustrating a modified example of the power supply system of the liquid-cooled LED lighting device according to an exemplary embodiment of the presently disclosed subject matter.
Figure 10:
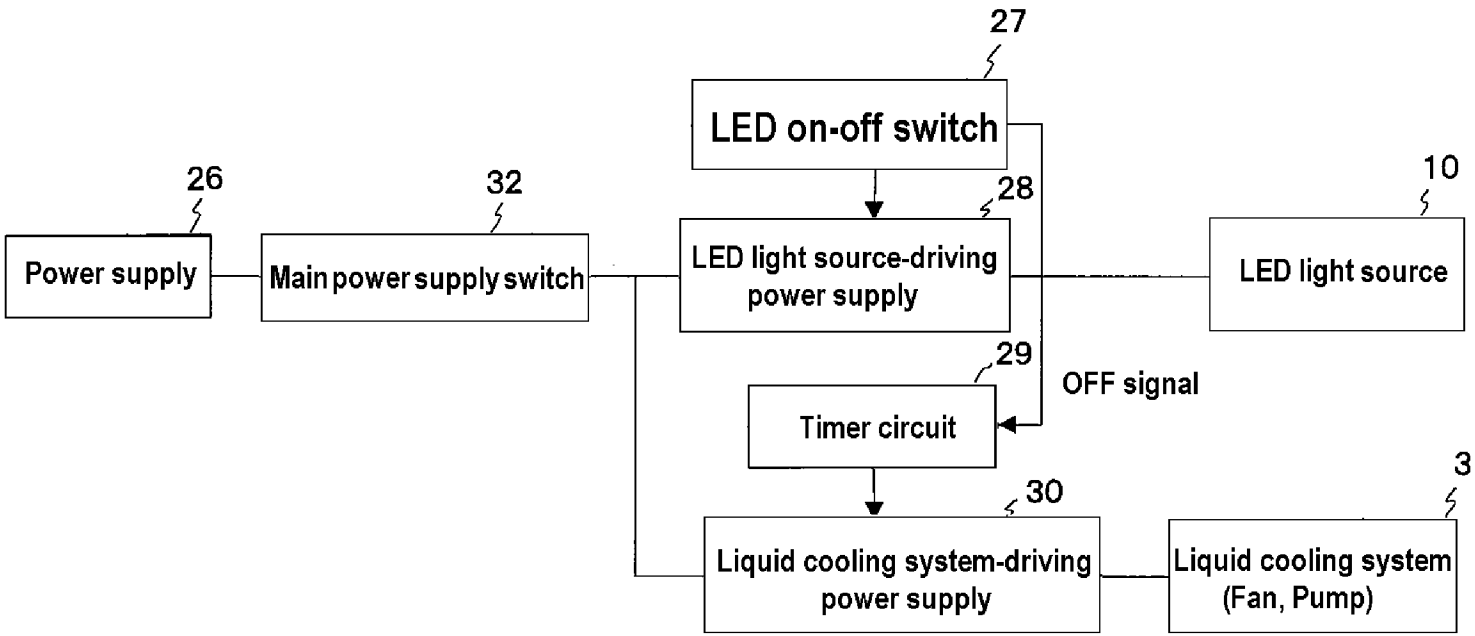
FIG. 10 is a block diagram illustrating another modified example of the power supply system of the liquid-cooled LED lighting device according to an exemplary embodiment of the presently disclosed subject matter.

A liquid cooling system-driving power supply 30 for supplying power to the fan 19 and the circulation pump 20 of the cooling system 3 can be also connected to the power supply (main power supply) 26. The timer circuit 29 can be connected to the liquid cooling system-driving power supply 30. As shown by broken lines in FIG. 8, a liquid cooling system switch 31 may be provided between the power supply 26 and the liquid cooling system-driving power supply 30, and the timer circuit 29 may be connected to the liquid cooling system switch 31. In the configuration shown in FIG. 8, a main power supply switch 32 may be additionally provided after the power supply 26, as shown in FIG. 9. Moreover, the LED on-off switch 27 may be provided separately as shown in FIG. 10, and the timer circuit 29 may be activated in response to an OFF signal from the LED on-off switch 27.

The present exemplary embodiment can be configured as follows. After the LED on-off switch 27 is switched off to stop the supply of power from the LED light source-driving power supply 28 to the LED light sources 10 so that the LED light sources 10 are turned off, the timer circuit 29 can be activated in response to the OFF signal from the LED on-off switch 27. The supply of power from the liquid cooling system-driving power supply 30 to the liquid cooling system 3 can be maintained for a preset time so that the fan 19 and the circulation pump 20 can remain energized.

Figure 11:
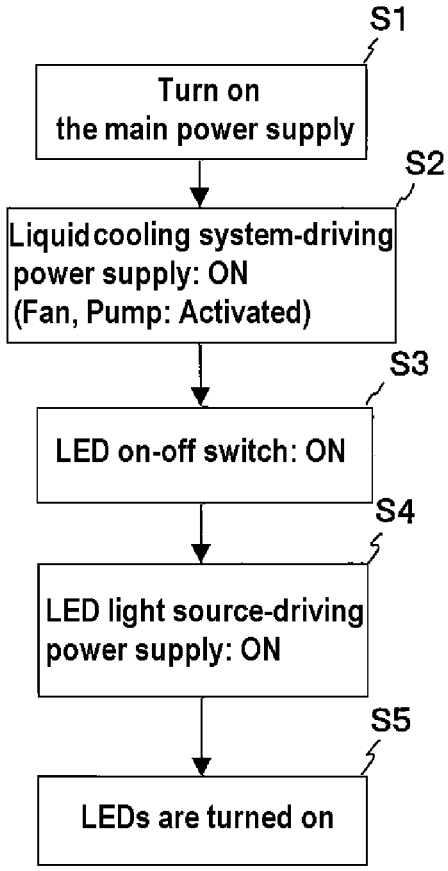

First, the exemplary control flow when the device is turned on will be described using a flowchart shown in FIG. 11.

When the main power supply 26 is turned on (step S1), the liquid cooling system-driving power supply 30 is turned on so that the fan 19 and the circulation pump 20 are actuated (step S2). Thereby the cooling liquid is circulated through the circulation path shown in FIG. 7 to cool the LED light sources 10, as described above. Subsequently, when the LED on-off switch 27 is switched on (step S3), the LED light source-driving power supply 28 is turned on. The power is thereby supplied to the LED light sources 10 (step S4), and the LED light sources 10 are turned on (step S5).

Figure 12:
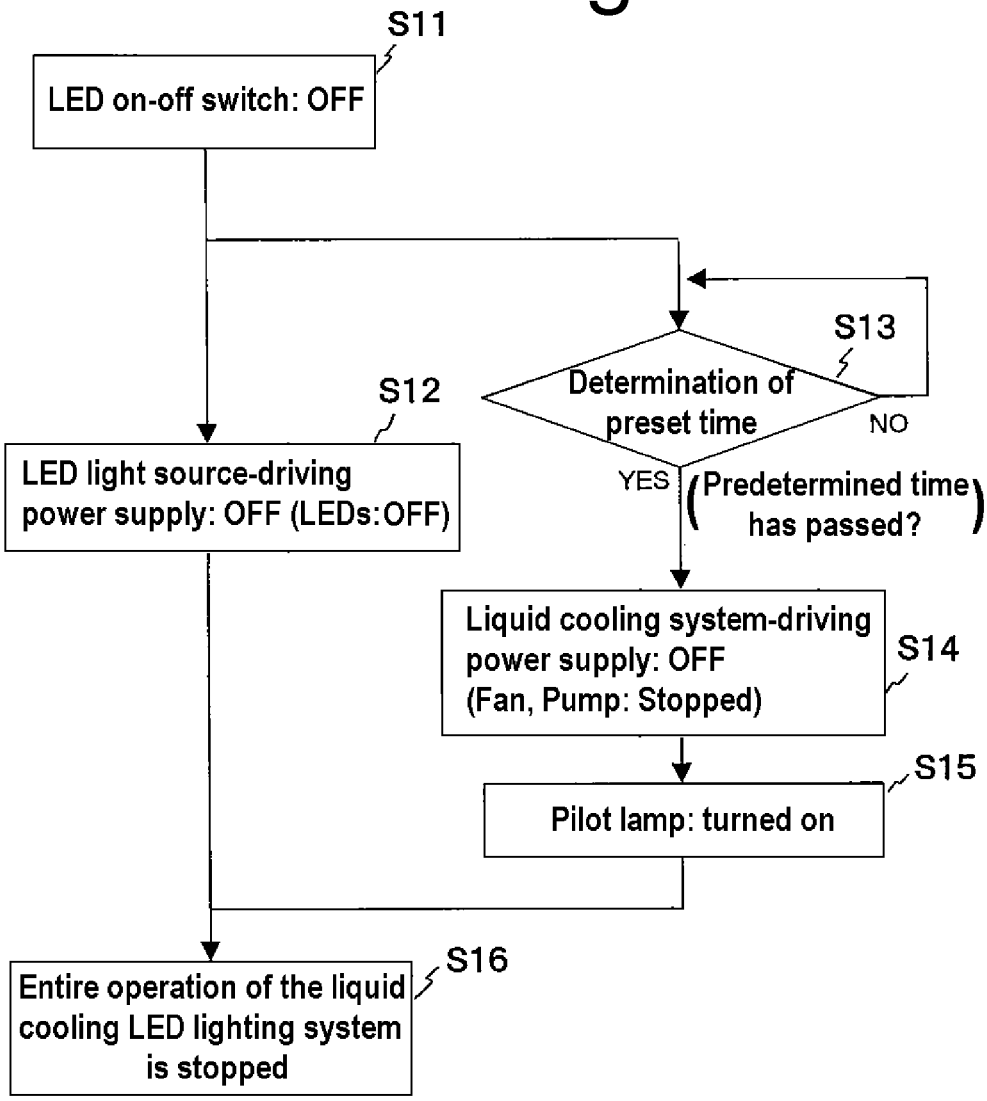
FIG. 12 is a flowchart showing the control flow when the liquid-cooled LED lighting device according to an exemplary embodiment of the presently disclosed subject matter is turned off.

Next, the control flow when the device is turned off will be described using a flowchart shown in FIG. 12. When the LED on-off switch 27 is switched off (step S11), the LED light source-driving power supply 28 is turned off (step S12). The supply of power to the LED light sources 10 is thereby stopped, and the LED light sources 10 are turned off. Then the OFF signal from the LED on-off switch 27 is sent to the timer circuit 29, and the timer circuit 29 is thereby activated to determine whether or not the predetermined preset time has elapsed after the LED on-off switch 27 is switched off (step S13).

The supply of power from the liquid cooling system-driving power supply 30 to the liquid cooling system 3 is maintained until the predetermined preset time has elapsed after the LED on-off switch 27 is switched off (if the determination result in step 13 is NO). Since the liquid cooling system 3 remains energized, the LED light sources 10 are still cooled. After the predetermined preset time elapses after the LED on-off switch 27 is switched off (if the determination result in step 13 is YES), the liquid cooling system-driving power supply 30 is turned off. The operations of the fan 19 and the circulation pump 20 are thereby stopped (step S14), and the circulation of the cooling liquid in the liquid cooling system 3 is stopped. In this case, a separate pilot lamp may be provided. Then, the pilot lamp is turned on (step S15). Since the pilot lamp in the ON state indicates that the liquid cooling system 3 has been stopped, the entire operation of the liquid-cooled LED lighting device 1 can be stopped by, for example, switching off the main power supply switch 32 after the state of the pilot lamp is checked (step S16). Alternatively, a separate detection circuit may be provided to the control circuit to output a control signal. Then, the control signal can turn the main power supply switch 32 off to completely stop the entire operation of the liquid-cooled LED lighting device 1 (step S16).

As described above, in the present exemplary embodiment, even after the supply of power from the LED light source-driving power supply 28 to the LED light sources 10 is stopped to turn the LED light sources 10 off, the timer circuit 29 can maintain the supply of power from the liquid cooling system-driving power supply 30 to the liquid cooling system 3 for a preset time, so that the fan 19 and the circulation pump 20 can remain energized. Therefore, a temporal increase in the temperature of the tubes (being rubber hoses) 16, 17, and 22 to 25 and the circulation pump 20 can be prevented, and the reliability of the liquid-cooled LED lighting device 1 can be thereby improved.

Table 2 shows the results of the measurement of the temperatures of the components (the LED light sources 10, heat receiving jacket 7, circulation pump 20, and radiator 18) of the liquid-cooled LED lighting device 1 of the present exemplary embodiment when the device is turned on and just after the device is turned off (at the outside air temperature of 25° C.). In addition, the previous table 1 is shown again for comparison.

TABLE 1

Conventional liquid-cooled LED lighting device

| | When device is ON | Just after device is turned off |
|---|---|---|
| LED light sources | 150° C. | 130° C. |
| Heat receiving jacket | 85° C. | 110° C. |
| Circulation pump | 60° C. | 80° C. |
| Radiator | 45° C. | 45° C. |
| Outside air | 25° C. | 25° C. |

TABLE 2

Liquid-cooled LED lighting device of the presently disclosed subject matter

| | When device is ON | Just after device is turned off |
|---|---|---|
| LED light sources | 150° C. | 130° C. |
| Heat receiving jacket | 85° C. | 70° C. |
| Circulation pump | 60° C. | 50° C. |
| Radiator | 45° C. | 35° C. |
| Outside air | 25° C. | 25° C. |

As is clear by comparing the results shown in Table 2 with the temperature measurement results for the conventional case shown in Table 1, the increase in the temperatures of the components just after the device is turned off can be suppressed in the liquid-cooled LED lighting device 1 of the present exemplary embodiment.

Next, a description will be given of another exemplary embodiments of the present invention.

Figure 13:
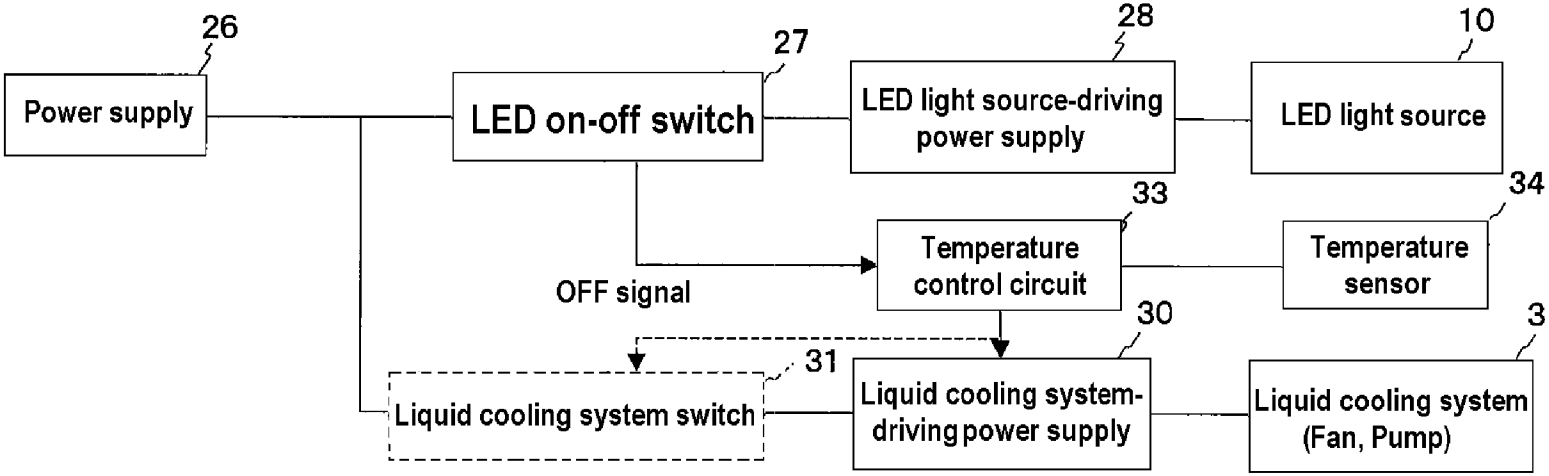
FIG. 13 is a block diagram illustrating the basic configuration of a power supply system of a liquid-cooled LED lighting device according to another exemplary embodiment of the presently disclosed subject matter.
Figure 14:
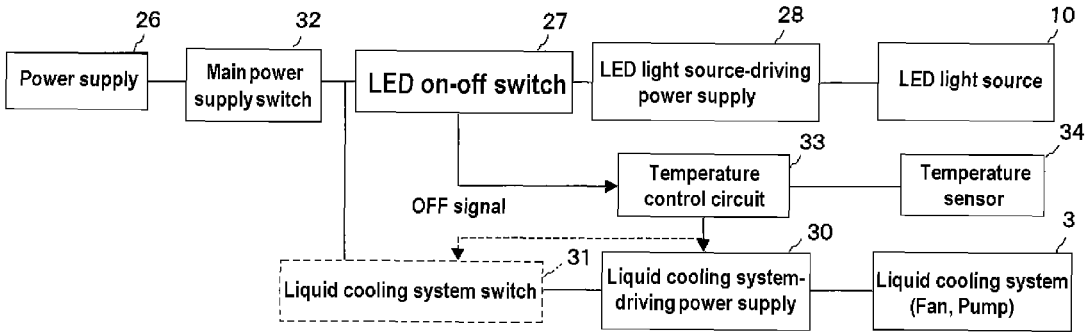
FIG. 14 is a block diagram illustrating a modified example of the power supply system of the liquid-cooled LED lighting device according to an exemplary embodiment of the presently disclosed subject matter.
Figure 15:
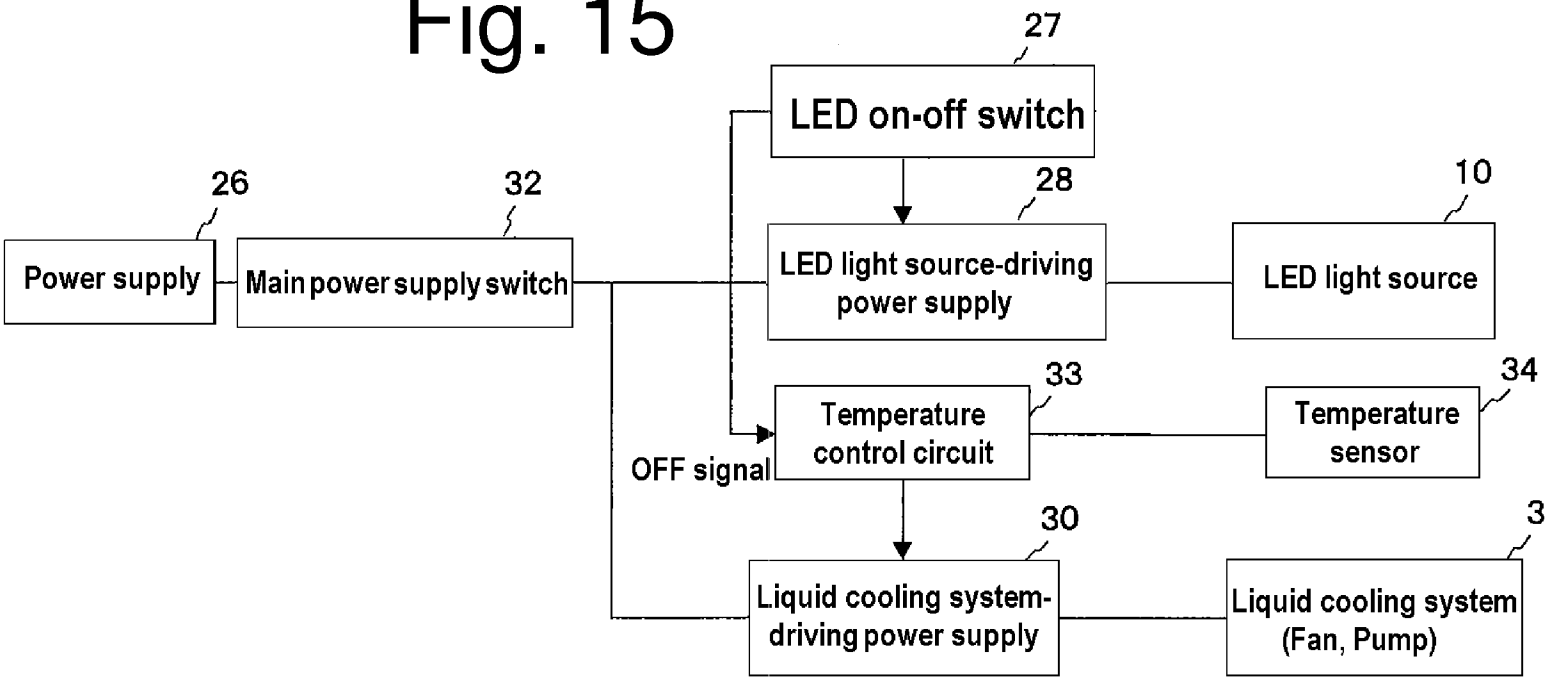
FIG. 15 is a block diagram illustrating another modified example of the power supply system of the liquid-cooled LED lighting device according to an exemplary embodiment of the presently disclosed subject matter.

FIGS. 13 to 15 are block diagrams illustrating the basic configurations of the power supply systems for a liquid-cooled LED lighting device according to other exemplary embodiments of the presently disclosed subject matter. In the power supply systems shown in these drawings, the timer circuit 29 shown in FIGS. 8 to 11 is replaced with a temperature control circuit 33.

The temperature control circuit 33 can include a temperature sensor 34 secured to any of the LED light sources 10, the heat receiving jacket 7, and the metal plate 6 in contact with the heat receiving jacket 7. The temperature control circuit 33 can control to maintain the supply of power to the liquid cooling system 3 for a period of time in response to a detection signal from the temperature sensor 34. A thermistor or a temperature detection IC can be used as the temperature sensor 34.

The exemplary control flow of the liquid-cooled LED lighting device 1 in the present exemplary embodiment, when the device is turned on under normal conditions, is the same as that in the previous exemplary embodiment (see FIG. 11), and the description thereof is omitted. Hereinafter, a description will be given of other exemplary control flows of the liquid-cooled LED lighting device 1 when the device is turned off and when it is turned on under the cool conditions based on FIGS. 16 and 17, respectively.

Figure 16:
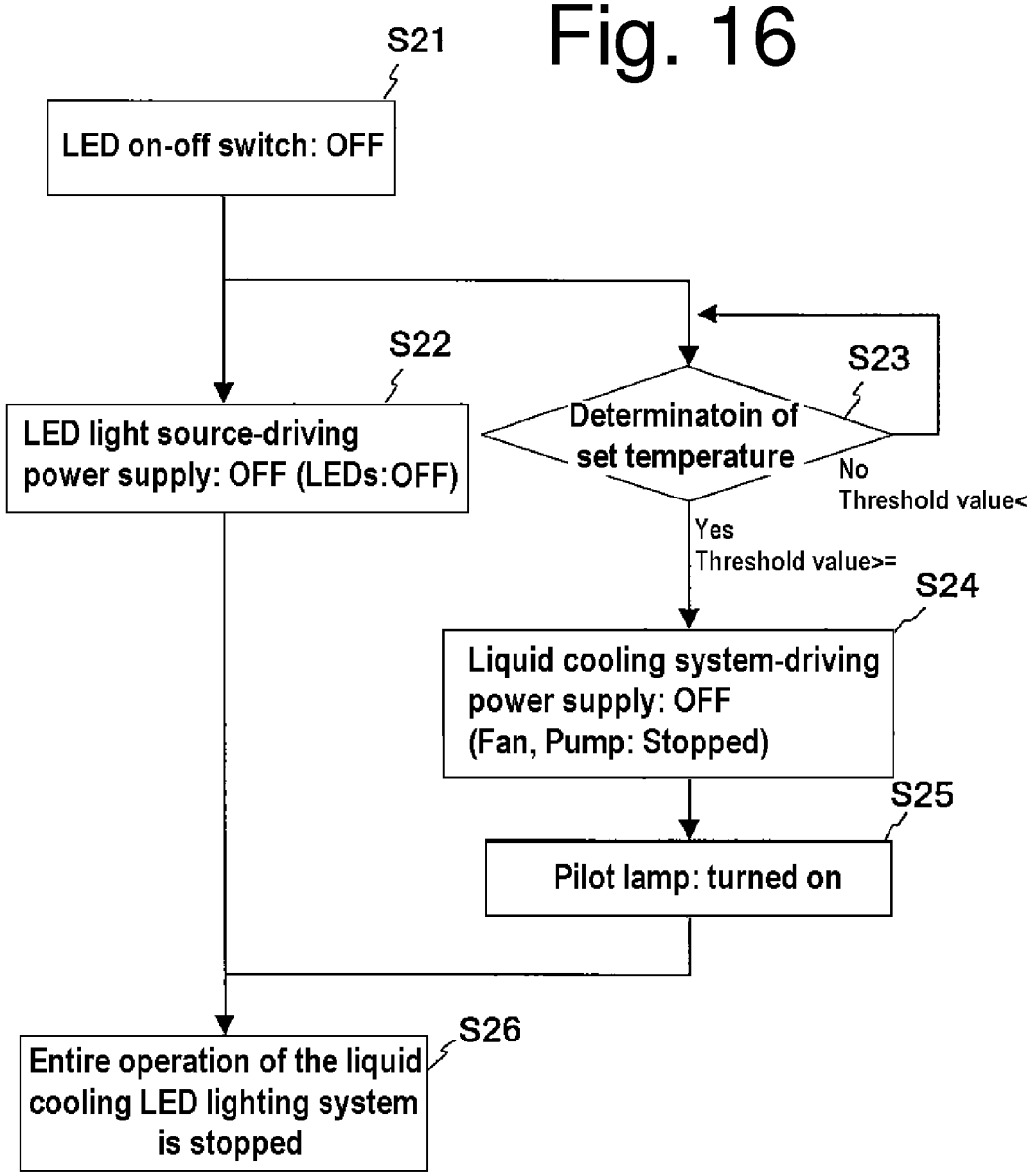
FIG. 16 is a flowchart showing the control flow when the liquid-cooled LED lighting device according to an exemplary embodiment of the presently disclosed subject matter is turned off.

As shown in FIG. 16, in the present exemplary control flow when the device is turned off, if the LED on-off switch 27 is switched off (step S21), the LED light source-driving power supply 28 is turned off (step S22). The supply of power to the LED light sources 10 is thereby stopped, and the LED light sources 10 are turned off. At the same time, the OFF signal from the LED on-off switch 27 is sent to the temperature control circuit 33. The temperature control circuit 33 is thereby activated to determine whether or not the temperature detected by the temperature detection element is equal to or lower than a predetermined threshold value (step S23).

The supply of power from the liquid cooling system-driving power supply 30 to the liquid cooling system 3 is maintained if the temperature detected by the temperature detection element is higher than the threshold value (if the determination result in step S23 is NO). Since the liquid cooling system 3 remains energized, the LED light sources 10 are still cooled. When the temperature detected by the temperature detection element is equal to or lower than the threshold value (if the determination result in step S23 is YES), the liquid cooling system-driving power supply 30 is turned off. The operations of the fan 19 and the circulation pump 20 are thereby stopped (step S24), and the circulation of the cooling liquid in the liquid cooling system 3 is stopped. Then a pilot lamp (not shown) is turned on (step S25), and the entire operation of the liquid-cooled LED lighting device 1 can be stopped by, for example, switching off the main power supply switch 32 (step S26).

As described above, in the present exemplary embodiment, even after the supply of power from the LED light source-driving power supply 28 to the LED light sources 10 is stopped to turn the LED light sources 10 off, the supply of power from the liquid cooling system-driving power supply 30 to the liquid cooling system 3 can be maintained until the temperature detected by the temperature detection element is decreased to the threshold value or lower, so that the fan 19 and the circulation pump 20 remain energized. Therefore, a temporal increase in the temperature of the tubes (rubber hoses) 16, 17, and 22 to 25 and the circulation pump can be prevented, and the reliability of the liquid-cooled LED lighting device 1 is thereby improved.

Figure 17:
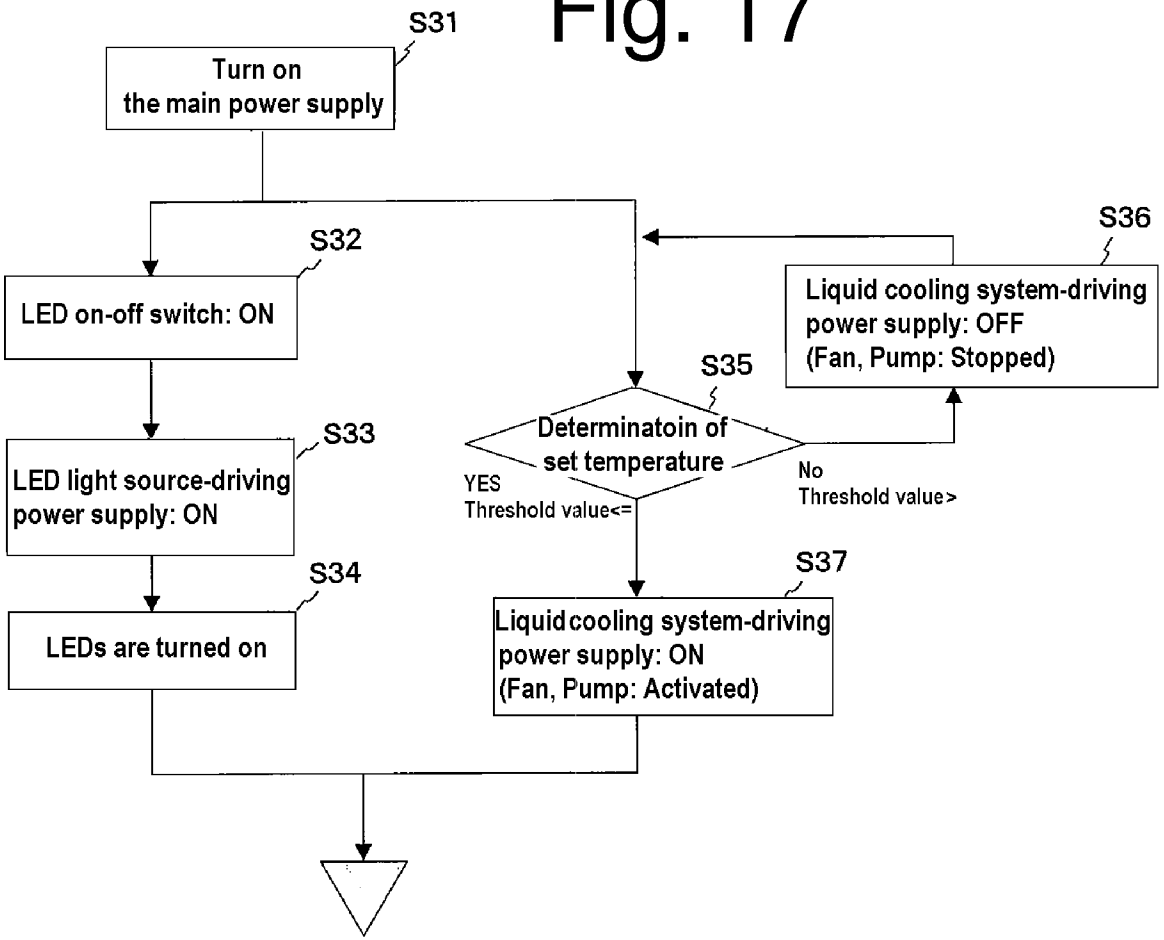
FIG. 17 is a flowchart showing the control flow when the liquid-cooled LED lighting device according to an exemplary embodiment of the presently disclosed subject matter is turned on under cool conditions.

Next, the exemplary control flow when the device is turned on under the cool conditions will be described with reference to FIG. 17.

In the case where the LED light sources 10 are turned on under the cool conditions in which the temperature of outside air is low, if the main power supply is turned on (step S31) and the LED on-off switch 27 is switched on (step S32), the LED light source-driving power supply 28 is turned on. The LED light sources 10 are thereby supplied with power (step S33), to be turned on (step S34).

At the same time, a determination is made whether or not the temperature detected by the temperature sensor 34 is equal to or higher than a predetermined threshold value (step S35). The OFF state of the liquid cooling system-driving power supply 30 is maintained when the detected temperature is lower than the threshold value (if the determination result in step S35 is NO), and power is not supplied to the liquid cooling system 3 (step S36), so that the liquid cooling system 3 is not energized. When the temperature detected by the temperature sensor 34 is increased to the threshold value or higher (if the determination result in step S35 is YES), the liquid cooling system-driving power supply 30 is turned on, and the fan 19 and the circulation pump 20 are actuated (step S37). The cooling liquid starts circulating in the liquid cooling system 3, and the required cooling effect is achieved. Also in this case, control when the LED light sources 10 are turned off is performed according to the flow shown in FIG. 16.

As described above, in the present exemplary embodiment, under the cool conditions in which the temperature detected by the temperature detection element when the LED light sources 10 are turned on is less than the predetermined threshold value, power is not supplied to the liquid cooling system 3 until the temperature detected by the temperature detection element is equal to or higher than the predetermined threshold value. Since cooling is not effected during this period, the entire liquid-cooled LED lighting device 1 can be rapidly warmed to the required operating temperature.

Next, a description will be given of still another exemplary embodiment of the presently disclosed subject matter with reference to FIG. 18 in which a configuration is illustrated as a modified example of the configuration of FIG. 11. It should be noted that in the present exemplary embodiment a temperature detection element (being the temperature sensor 34) is assumed to be mounted on the same substrate as the LED light sources 10. Hereinafter, the exemplary operation flow chart will be described with reference to FIGS. 18 and 19.

Figure 18:
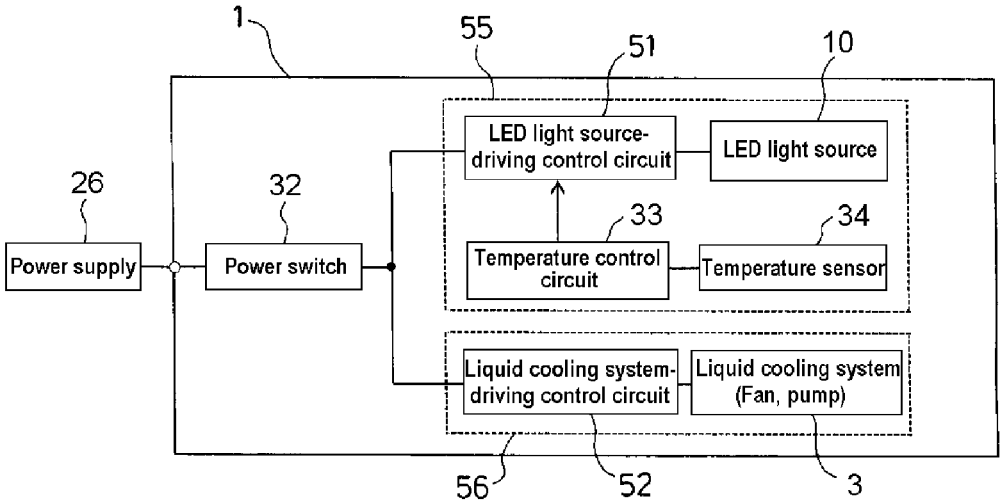
FIG. 18 is a block diagram illustrating a power supply system of the liquid-cooled LED lighting device according to another exemplary embodiment of the presently disclosed subject matter.

As shown in FIG. 18, the system configuration of the LED lighting device 1 can be configured such that a power switch 32 connecting to an external power supply 26 can be connected to an LED light source-driving control circuit 51 and a liquid cooling system-driving control circuit 52.

The LED light source-driving control circuit 51 can be connected to LED light sources 10 that can be driven with the control signal therefrom. The liquid cooling system-driving control circuit 52 can be connected to a liquid cooling system 3 that can be composed of a radiator, a fan that supplies cooling wind to the radiator and a circulation pump that circulates a cooling liquid.

A terminal of the temperature sensor 34 can be connected to an input terminal of a temperature control circuit 33, an output terminal of which can be then connected to an input terminal of the LED light source-driving control circuit 51. The output from the temperature sensor 34 can be delivered to the temperature control circuit 33, and then, the temperature control circuit 33 can deliver an output that has been previously set based on the output from the temperature sensor 34 to the LED light source-driving control circuit 51. The LED light source-driving control circuit 51 can output a control current to the LED light sources 10 for driving them.

When the components are classified by their functions, the LED light sources 10, the temperature sensor 34, the temperature control circuit 33 and the LED light source-driving control circuit 51 can constitute the LED light source drive unit 55, while the liquid cooling system 3 and the liquid cooling system-driving control circuit 52 can constitute the liquid cooling system driving unit 56.

Figure 19:
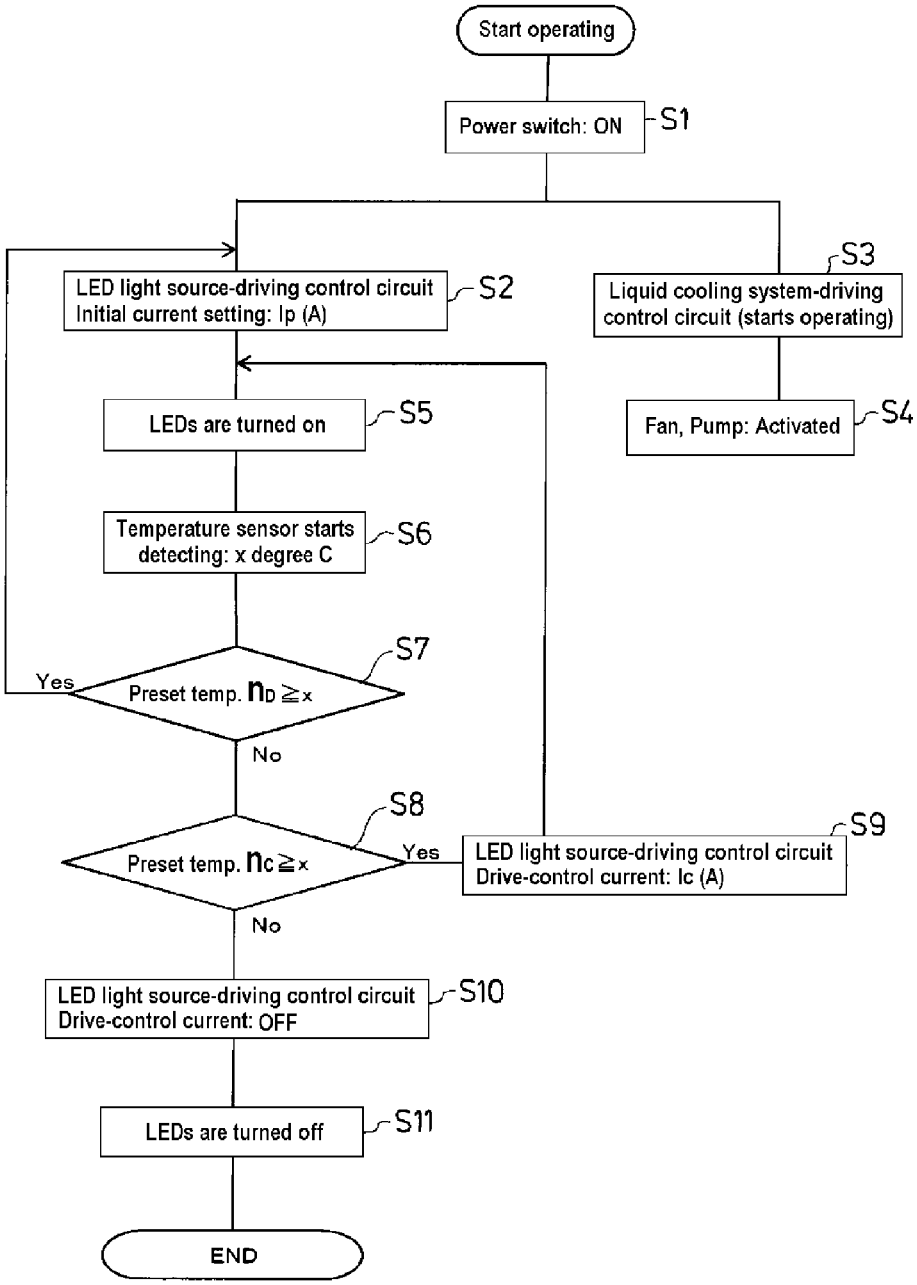

FIG. 19 is a flowchart showing an exemplary operational flow of the LED lighting device having the above configuration. First, in step S1 the power switch 32 is turned on, and thereby the LED light source-driving control circuit 51 and the liquid cooling system-driving control circuit 52 are simultaneously supplied with power in steps S2 and S3, respectively.

Then, in step S4 the liquid cooling system 3 (including a fan and a circular pump) is actuated by the liquid cooling system-driving control circuit 52. At the same time, an initial current Ip (A) is supplied to the LED light sources 10 by the LED light source-driving control circuit 51 to drive the LED light sources 10 (being turned on) in step S5.

When the LED light sources 10 are turned on, in step S6 the temperature sensor 34 starts detecting the temperature of the substrate on which the LED light sources 10 are mounted. Next, in step S7 the temperature control circuit 33 compares the detected substrate temperature x (° C.) with a preset temperature $n_D$ (° C.). If the substrate temperature x is equal to or lower than the preset temperature $n_D$ ($n_D \geq x$), the control process returns to step S2 to maintain the initial current Ip (A) for the LED light sources 10 being turned on.

If the substrate temperature x is higher than the preset temperature $n_D$ ($n_D < x$), the temperature control circuit 33 further compares in the next step S8 the detected substrate temperature x (° C.) with another preset temperature $n_C$ (° C.). If the substrate temperature x is equal to or lower than the preset temperature $n_C$ ($n_C$ x), the temperature control circuit 33 delivers an output preset based on the substrate temperature x to the LED light source-driving control circuit 51. In the next step S9, a drive-control current Ic (A) corresponding to the substrate temperature x is supplied to the LED light sources 10 for driving (being turned on).

If the substrate temperature x is higher than the preset temperature $n_C$ ($n_C < x$) in step S8, the temperature control circuit 33 delivers an output for turning off the LED light sources 10 to the LED light source-driving control circuit 51.

In step S10, the drive current to the LED light sources 10 is interrupted by the LED light source-driving control circuit 51 to turn the LED light sources 10 off in step S11.

Hereinafter, a description will be given of the relationship between the substrate temperature detected by the temperature sensor 34 and the current supplied to the LED light source 10 with reference to FIG. 20.

Figure 20:
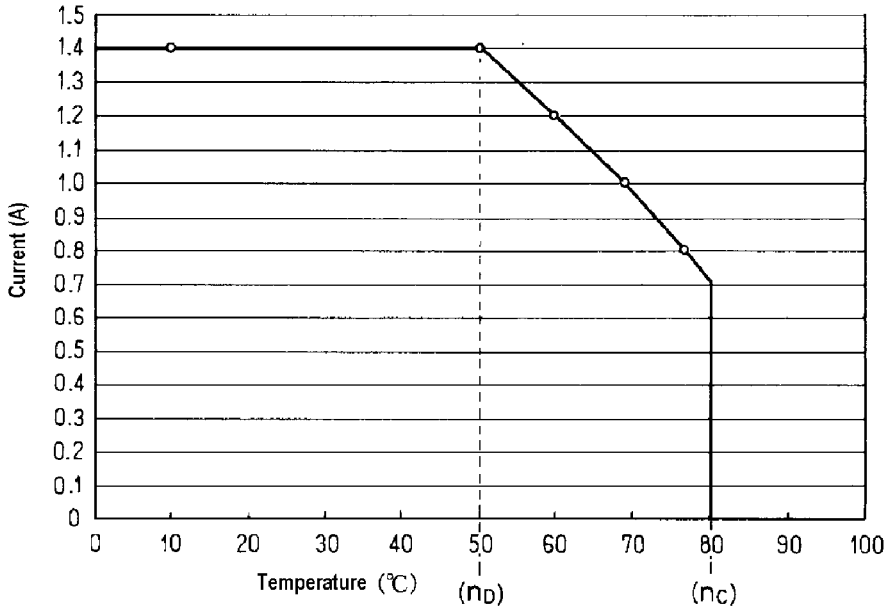
FIG. 20 is a graph including a derating curve.

FIG. 20 is a graph illustrating a so-called degrading curve showing the relationship between the substrate temperature and the drive current for the LED light source 10, which is the basis for suppressing the junction temperature (Tj) of an LED light source 10 to ensure the reliability of the device.

When the preset temperatures $n_D$ (° C.) and $n_C$ (° C.), the initial current Ip (A) and the control current Ic (A) in the above operation flow chart are considered with reference to the derating curve, the preset temperatures $n_D$ (° C.) and $n_c$ (° C.) can be determined as approximately 50° C. and 80° C., respectively. Accordingly, if the substrate temperature x is equal to or lower than the preset temperature $n_D$ (approximately 50° C.) ($n_D$ x), the initial current Ip can be set to approximately 1.4 (A). If the substrate temperature x is between these present temperatures $n_D$ (approximately 50° C.) and $n_c$ (approximately 80° C.) ($n_c$ x>$n_D$), the control current Ip can be set to the current range read from the derating curve with respect to the substrate temperature x at that time (namely, between approximately 1.4 (A) and 0.7 (A)).

If the substrate temperature x is higher than the preset temperature $n_C$ (approximately 80° C.) ($n_C$<x), the drive current for the LED light sources 10 is interrupted to turn the LED light sources 10 off.

In the present exemplary embodiment, the substrate temperature on which the LED light sources 10 are mounted can be detected to indirectly grasp the junction temperature (Tj) of the LED light sources 10. Then, a drive control current can be set based on the derating curve to be supplied to the LED light sources 10, thereby preventing the LED light sources 10 from being excessively increased in temperature and thereby increasing the reliability of the LED light sources 10.

When the temperature of the substrate exceeds a predetermined temperature, the LED light sources 10 can be turned off. This configuration can protect the LED light sources 10 from the abnormal temperature increase, thereby ensuring safety, including that of the entire device.

In the present exemplary embodiment, the device body can include a plurality of LED light source modules 5. However, the presently disclosed subject matter is not limited to this embodiment, and the device body can include a single LED light source module in which LED light sources 10, connectors, and a temperature sensor 34 are mounted on a single substrate.

Figure 21:
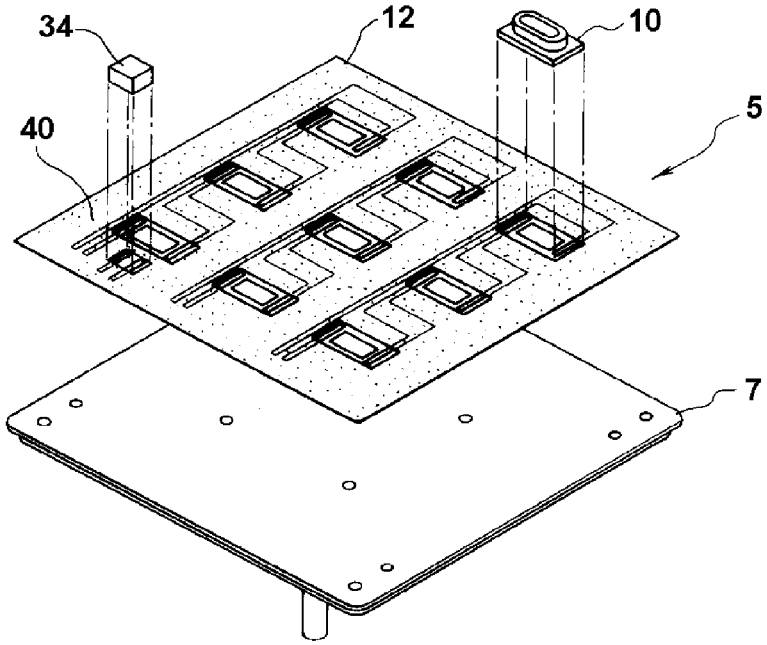
FIG. 21 is a partial perspective exploded view showing part of the components of the liquid-cooled LED lighting device according to another exemplary embodiment of the presently disclosed subject matter.

FIG. 21 is a diagram illustrating the physical relationship between the LED light source modules 5 and the heat receiving jacket 7 according to another exemplary embodiment. The present exemplary embodiment can be configured in addition to the configuration of the previous exemplary embodiment by directly adhering the LED light source modules 5 to the heat receiving jacket 7 by utilizing a heat conductive adhesive (not shown) without the intervention of a heat conductive base plate. The other configuration can be the same as that of the previous exemplary embodiment. In this case, the substrate 12 on which the LED light sources 10 and the temperature sensor 34 are mounted can be the same as that in the previous exemplary embodiment, such as a metal substrate, a ceramic substrate, and/or a flexible substrate. Of these substrate materials, a thin substrate with flexibility can be used because the structure is bonded by using an adhesive.

In the disclosed embodiments, the substrate can be covered with a resist layer 40 at areas other than the area where the LED light sources 10, the temperature sensor 34 and connectors (not shown) are mounted thereon. Namely, the temperature sensor 34, the LED light sources 10 and the connectors for receiving drive power for the LED light sources 10 are mounted on an area where the resist layer 40 is not provided.

As described above, the LED lighting device 1 can be configured such that the device body does not need a heat conductive base plate. In this configuration, the heat generated from the LED light sources 10 can be effectively transferred to the heat receiving jacket 7, thereby enhancing the suppression effect of the temperature increase of the LED light sources. Furthermore, it is possible to make the LED lighting device thinner, thereby lowering the manufacturing costs.

Figure 22:
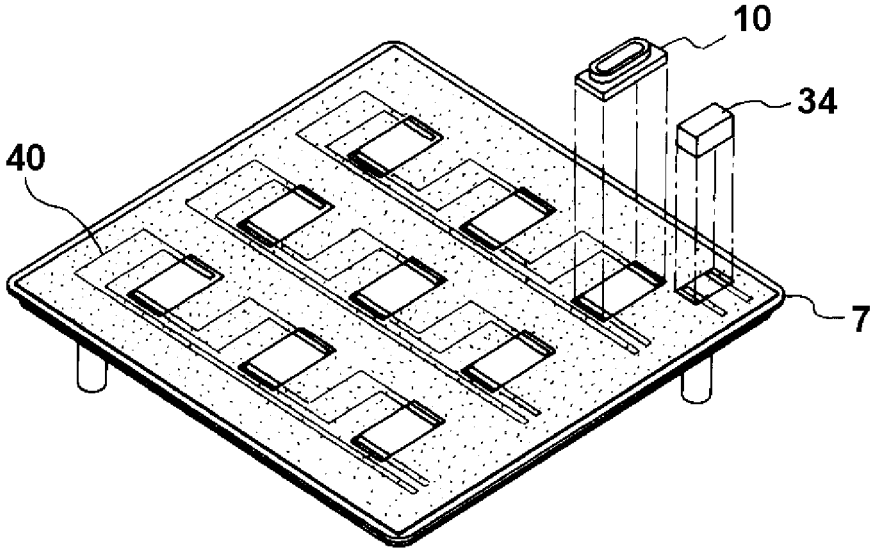
FIG. 22 is a partial perspective exploded view showing part of the components of the liquid-cooled LED lighting device according to another exemplary embodiment of the presently disclosed subject matter.

FIG. 22 is a diagram illustrating the relationship between the LED light sources 10 and the heat receiving jacket 7 according to another exemplary embodiment. The present exemplary embodiment can be configured in addition to the configuration of the previous exemplary embodiment by mounting the LED light sources 10 and the temperature sensor 34 not on the substrate, but directly on the heat receiving jacket 7. The other configurations can be the same as that of the previous exemplary embodiment. In this case, the heat receiving jacket 7 can have a wiring pattern formed on one surface thereof with an insulation layer interposed therebetween, and the heat receiving jacket 7 can be covered with a resist layer 40 at areas other than the area where the LED light sources 10, the temperature sensor 34 and connectors (not shown) are mounted thereon.

Namely, the temperature sensor 34, the LED light sources 10 and the connectors for receiving drive power for the LED light sources 10 are mounted on the area where the resist layer 40 is not provided.

As described above, the LED lighting device 1 can be configured such that the LED light sources 10 and the like are mounted directly on the heat receiving jacket 7. In this configuration, the heat generated from the LED light sources 10 can be effectively transferred to the heat receiving jacket 7, thereby enhancing the suppression effect of the temperature increase of the LED light sources. Furthermore, it is possible to make LED lighting device thinner, thereby lowering manufacturing costs.

In the above exemplary embodiments, the power switch is provided to the LED lighting device. Alternatively, the power switch can be provided outside the LED lighting device.

As described above, the liquid-cooled LED lighting device can have a liquid cooling system for heat dissipation of the LED light source. This system can improve heat dissipation efficiency as compared to an air cooling system, thereby allowing LED light sources having increased power. As a result, LED lighting device having higher illumination intensity can be manufactured.

Furthermore, the LED lighting device can have a temperature sensor that can output a detected temperature value, and accordingly, the LED light sources can be driven by a control current based on the detected temperature. The liquid-cooled LED lighting device can suppress excess temperature increases when the LED light sources are turned off to maintain a stable state, thereby achieving stable outputted illumination intensity and life. Furthermore, the liquid-cooled LED lighting device can ensure the safety of the device, including the LED light sources, by interrupting the drive current if the temperature of the cooling liquid abnormally increases.

Figure 23:
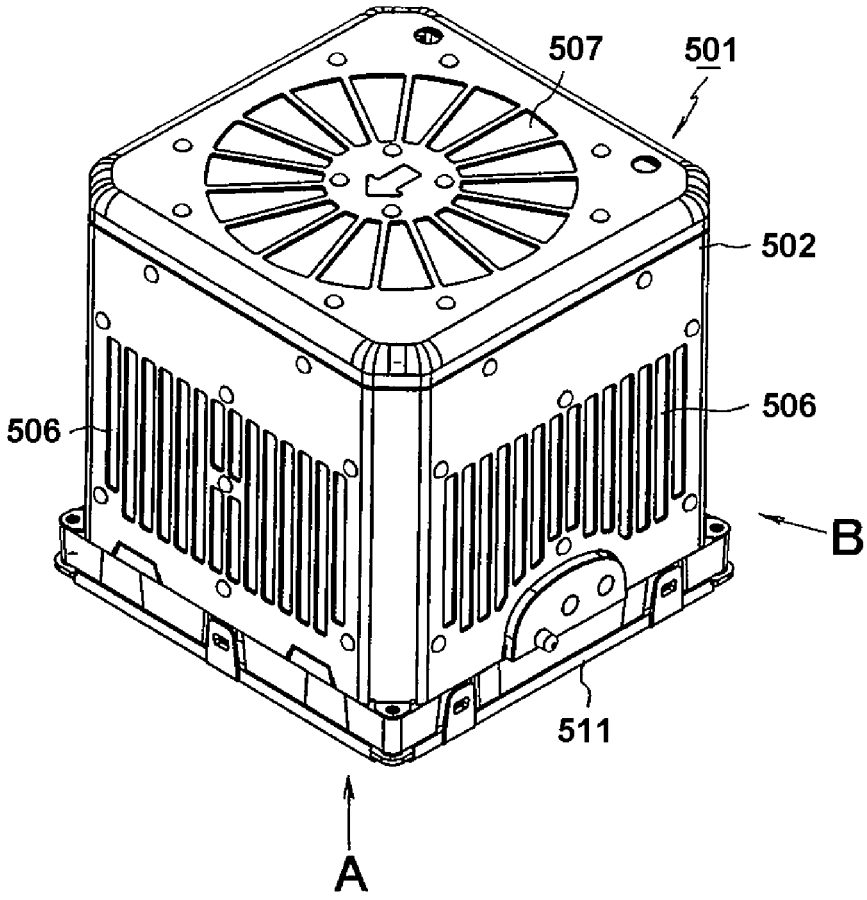
FIG. 23 is a perspective view illustrating a liquid-cooled LED lighting device according to another exemplary embodiment of the presently disclosed subject matter.
Figure 24:
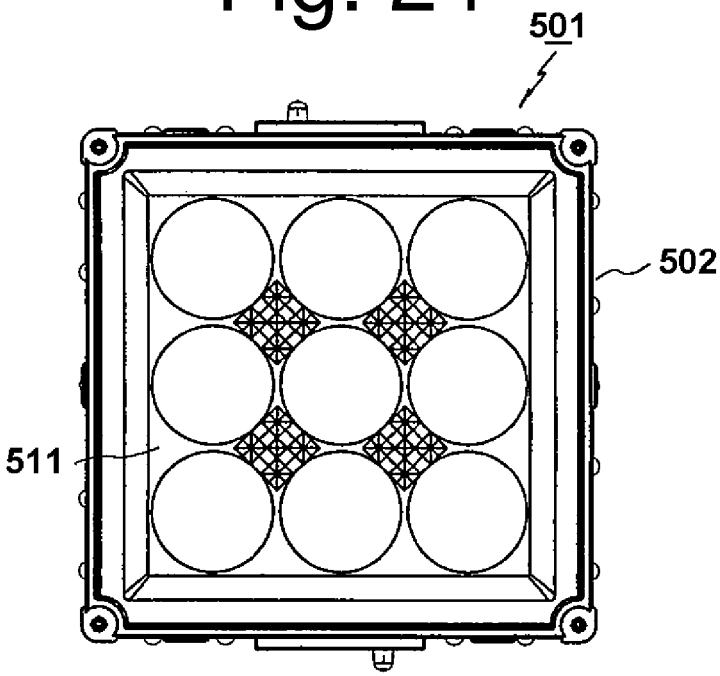
FIG. 24 is a diagram illustrating the liquid-cooled LED lighting device viewed from arrow A in FIG. 23.
Figure 25:
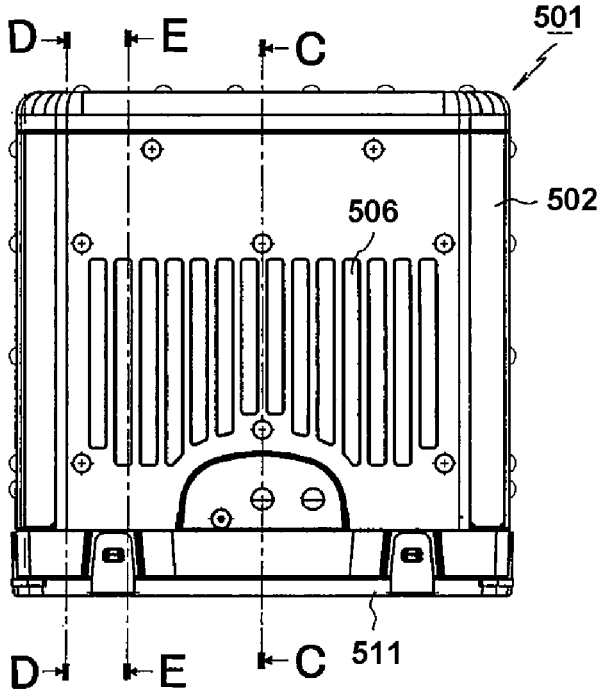
FIG. 25 is a diagram illustrating the liquid-cooled LED lighting device viewed from arrow B in FIG. 23.
Figure 26:
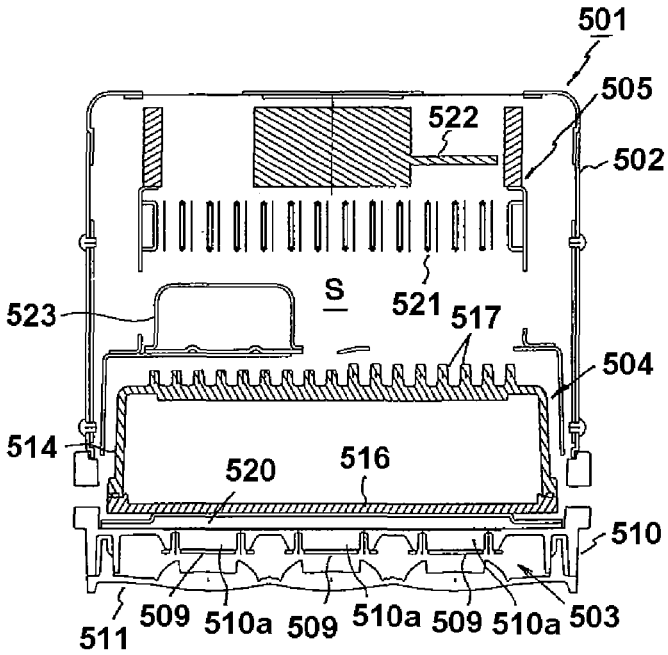
FIG. 26 is a cross-sectional view taken along line C-C of FIG. 25.
Figure 27:
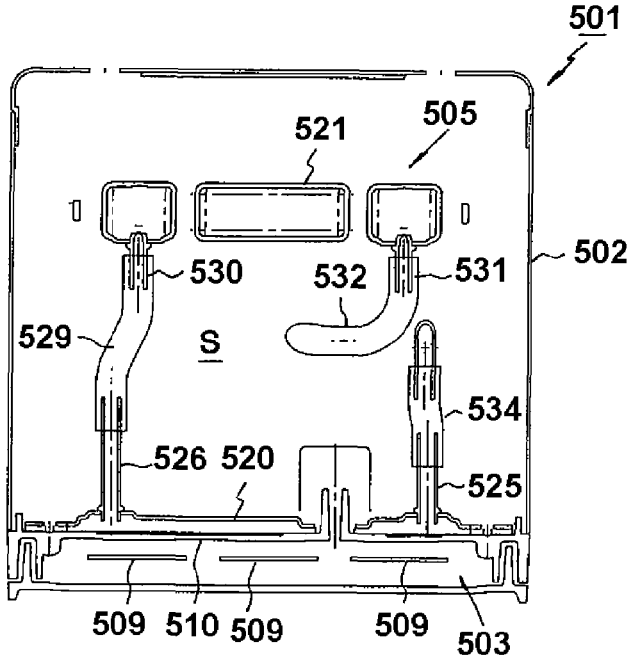
FIG. 27 is a cross-sectional view taken along line D-D of FIG. 25.
Figure 28:
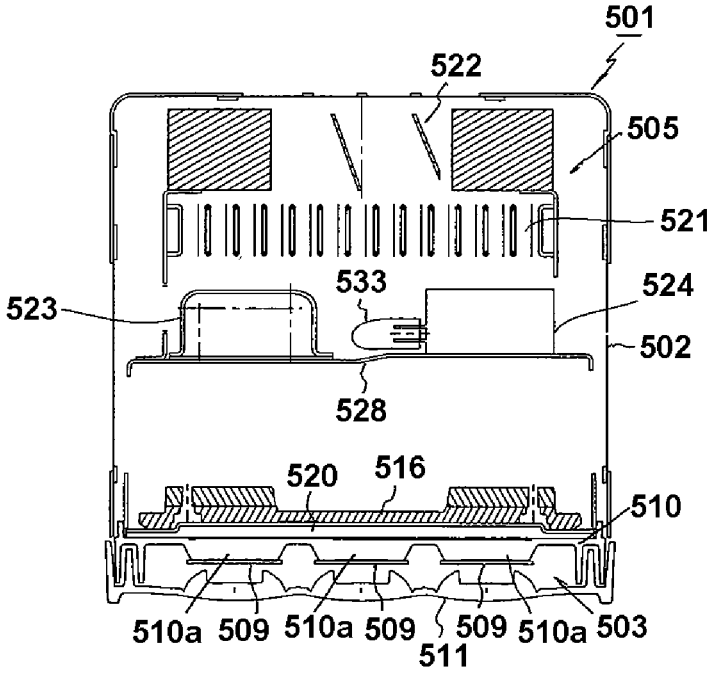
FIG. 28 is a cross-sectional view taken along line E-E of FIG. 25.
Figure 29:
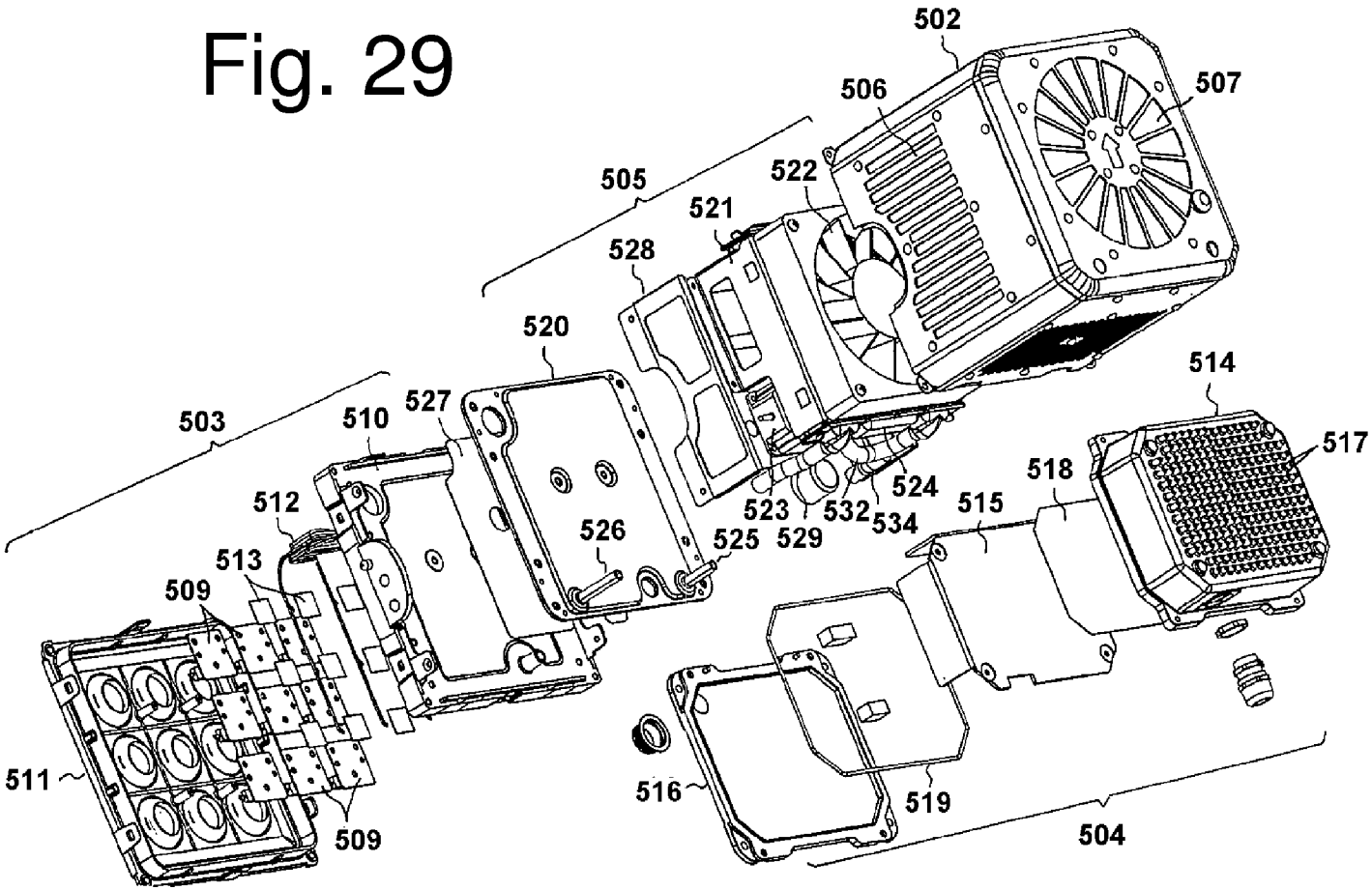
FIG. 29 is an exploded perspective view of the liquid-cooled LED lighting device according to another exemplary embodiment of the presently disclosed subject matter.
Figure 30:
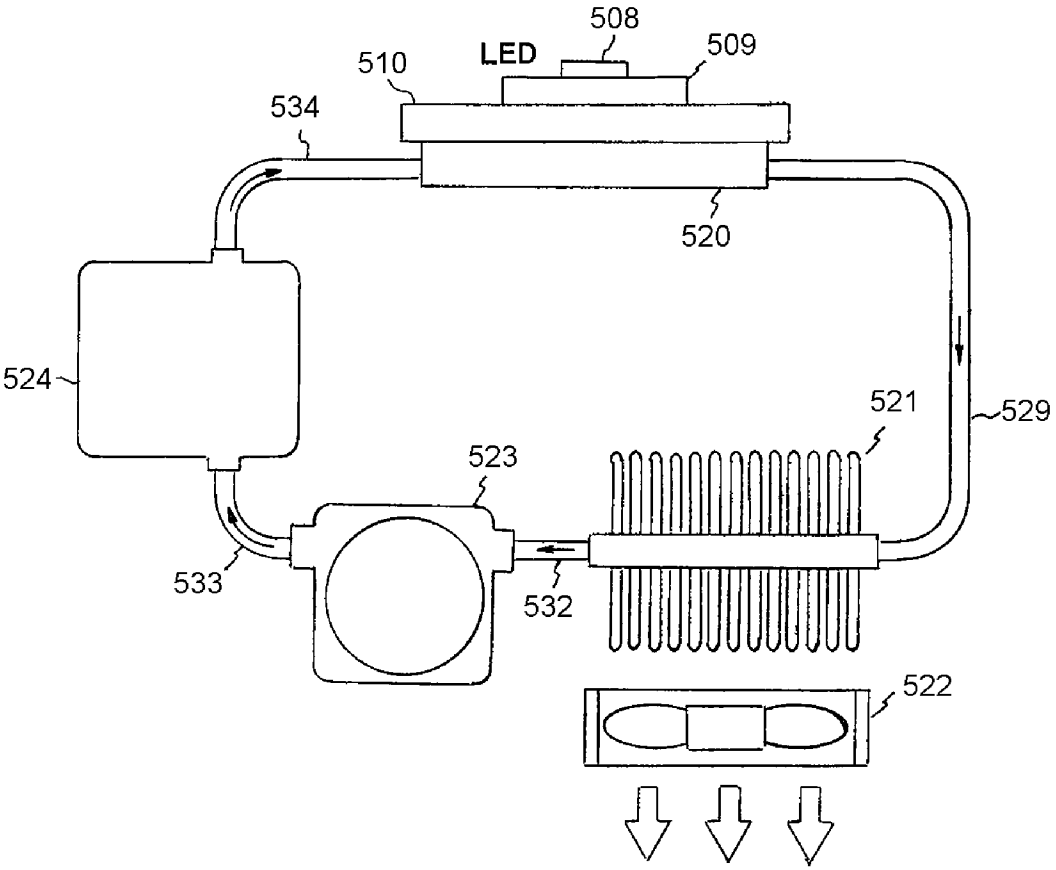
FIG. 30 is a diagram illustrating the basic configuration of a liquid cooling system of the liquid-cooled LED lighting device of the presently disclosed subject matter.

FIG. 23 is a perspective view illustrating a liquid-cooled LED lighting device according to another exemplary embodiment of the presently disclosed subject matter. FIG. 24 is a diagram illustrating the liquid-cooled LED lighting device viewed from arrow A in FIG. 23. FIG. 25 is a diagram illustrating the liquid-cooled LED lighting device viewed from arrow B in FIG. 23. FIG. 26 is a cross-sectional view taken along line C-C of FIG. 25. FIG. 27 is a cross-sectional view taken along line D-D of FIG. 25. FIG. 28 is a cross-sectional view taken along line E-E of FIG. 25. FIG. 29 is an exploded perspective view of the liquid-cooled LED lighting device according to another exemplary embodiment of the presently disclosed subject matter. FIG. 30 is a diagram illustrating the basic configuration of a liquid cooling system of the liquid-cooled LED lighting device of the presently disclosed subject matter.

The liquid-cooled LED lighting device of the presently disclosed subject matter can be used in dangerous areas such as chemical plants, gas stations, and the like. As shown in FIGS. 26 to 29, the liquid-cooled LED lighting device can be configured to include a light source unit 503, an air-cooling heat dissipation system 504 and a liquid-cooling heat dissipation system 505 that are incorporated inside a cubic housing 502. It should be noted that the air-cooling heat dissipation system 504 may not be provided if the liquid-cooling heat dissipation system 505 is sufficient for the intended purpose.

In the following description of the subject application with reference to FIGS. 23 to 35, the vertical direction (up and down, top and rear and the like) may be determined based on the orientation shown in the drawings. In other words, the liquid-cooled LED lighting device 105 is not installed with the orientation illustrated in FIG. 23.

The housing 502 can be formed of a resin material such as polycarbonate (PC) or a metal material such as aluminum. As shown in FIG. 23, inlet ports 506 including a plurality of longitudinal slits can be formed along the periphery of the housing 502. Discharge ports 507 including a plurality of fan shaped slits can be formed on the top surface thereof. The housing 502 can have a lower opening, to which the light source unit 503 is fitted.

The light source unit 503 can be configured to include a metal substrate 509 on which a plurality of (nine (9) in the drawings) LED light sources 508 (see FIG. 30) can be mounted, a rectangular plate-like metal base 510 to which the metal substrate 509 is attached, and a rectangular plate-like transparent lens 511 to be fitted to the lower opening of the housing 502. Herein, the transparent lens 511 can be formed of a glass or an inflammable resin material. In FIG. 29, reference numeral 512 is a cable connector.

The nine metal substrate 509 on which the LEDs 508 have been mounted can be arranged in a 3×3 matrix form. Seats 510*a*, the number of which is the same as that of the LED 508, can be integrally formed with the metal base 510 prepared by aluminum die casting so that they protrude in a 3×3 matrix form (see FIGS. 26 and 28). The metal substrates 509 can be secured by screwing them to the respective seats 510*a* of the metal base 510 with the rectangular heat conductive sheets 513 interposed therebetween. The heat conductive sheets 513 each are formed of a silicone or similar material having a high insulation property and a high heat conductivity.

The air-cooling heat dissipation system 504 can include the cubic circuit casing 514 having a lower opening and a plurality of heat dissipation pins 517 serving as a heat sink. The heat dissipation pins 517 can be formed on the upper surface of the cubic circuit casing 514 as an atmospheric heat dissipation portion. Furthermore, a circuit substrate 515 on which various electronic components are mounted can be accommodated within the circuit casing 514. The lower opening of the circuit casing 514 can be covered with a rectangular plate-like cover 516. The circuit casing 514 is molded by aluminum die casting with a high heat conductivity, and the plurality of heat dissipation pins 517 constituting the atmospheric heat dissipation portion are protrudingly formed integrally on the top surface of the casing 514. Then, the circuit substrate 515 is provided in close contact with the inside top surface of the circuit casing 514 with the heat conductive sheets 518 intervening therebetween, the sheet 518 being made of a silicone with high insulating and heat conductive properties. An O-ring 519 can be disposed in between the circuit casing 514 and the cover 516 at the point where they are joined together. The sealing effect of the O-ring 519 can provide a hermetically sealed space within the circuit casing 514 so that any dust and moisture can be prevented from entering the inside of the circuit casing 514 from outside. In the present exemplary embodiment, the heat dissipation pins 517 are protrudingly provided on the circuit casing 514 to serve as an atmospheric heat dissipation portion. In place of the heat dissipation pins 517, heat dissipation fins may be formed in the circuit casing 514.

As shown in FIGS. 26 to 30, the liquid-cooling heat dissipation system 505 can be configured to include a heat receiving jacket 520, which acts as a heat exchanger, a radiator 521 configured to heat exchange between outside air flows (cooling air) and a cooling liquid that has been increased in temperature by receiving heat in the heat receiving jacket 520, a fan 522 configured to supply cooling air to the radiator 521, a circulation pump 523 configured to circulate the cooling liquid within a closed loop circulation path, and a reserve tank 524 configured to store the cooling liquid. The fan 522 can be disposed so as to face and be disposed above the radiator 521.

The heat receiving jacket 520 can be formed to have a hollow rectangular plate shape. As shown in FIGS. 26 to 28, the inside thereof can serve as a passage of a cooling liquid. As shown in FIGS. 27 and 29, the heat receiving jacket 520 can also include, at its end, an inlet piping 525 through which the cooling liquid cooled by heat exchange with outside air flows at the radiator 521, and a discharge piping 526 from which the cooling liquid that has received heat from the heat receiving jacket 520 is discharged (see FIG. 5).

As shown in FIGS. 26 and 28, the heat receiving jacket 520 can be disposed horizontally on the bottom inside of the housing 502. The air-cooling heat dissipation system 504 and the light source unit 503 can be disposed so that the heat receiving jacket 520 is interposed therebetween. The metal bases 510 of the light source unit 503 on the lower side of the heat receiving jacket 520 in the drawings can be in close contact with the lower surface of the heat receiving jacket 520 with the rectangular heat conductive sheets 527 interposed therebetween. Furthermore, the heat conductive sheets 527 can be formed of a silicone with high insulating and heat conductive properties.

The cover 516 of the air-cooling heat dissipation system 504 can be disposed on the upper side of the heat receiving jacket 520 so that the cover 516 can be in close contact with the surface of the heat receiving jacket 520. In the present exemplary embodiment, the cooling liquid can be a non-freezing fluid composed of a mixture of water and propylene glycol.

As shown in FIGS. 26 and 28, the radiator 521 and the fan 522 can be disposed above and away from the heat receiving jacket 520 inside the housing 502. A space S is formed between the heat receiving jacket 520 and the radiator 521 so that the air cooling unit 504, the circulation pump 523 and the reserve tank 524 can be disposed inside the space S. Specifically, a gate-shaped chassis 528 can be provided on the heat receiving jacket 520, and the air cooling unit 504 can be disposed inside the space surrounded by the chassis 528. On the chassis 528, there are the circulation pump 523 and the reserve tank 524.

As shown in FIGS. 27 and 30, a tube (rubber hose) 529 can be provided upward from the discharge piping 526 of the heat receiving jacket 520 and connected to the inlet piping 530 of the radiator 521. A tube (rubber hose) 532 can be extended from the discharge piping 531 of the radiator 521 and connected to the inlet side of the circulation pump 523. A tube (rubber hose) 533 can be extended from the discharging side of the circulation pump 523 and connected to the inlet side of the reserve tank 524 as shown in FIG. 30. Furthermore, a tube (rubber hose) 534 can be provided downward from the outlet side of the reserve tank 524 and connected to the inlet piping 525 of the heat receiving jacket 520. As described above, the heat receiving jacket 520, the radiator 521, the circulation pump 523 and the reserve tank 524 can be connected through the tubes 529 and 532 to 534 (or rubber hoses), so that a closed circulation path is formed. The required cooling effect can be achieved by circulation of the cooling liquid through the circulation path.

The liquid-cooled LED lighting device 501 as configured above can be activated to supply the light source unit 503, the circuit substrate and the liquid-cooling heat dissipation system 505 within the circuit casing 514 with power. Accordingly, the plurality of (nine (9) in the present exemplary embodiment) LEDs 508 of the light source unit 503 can emit light, which can passes through the transparent lens 511 to be projected downward in FIG. 23. Thereby, the area in front of the lighting device 501 can be illuminated. The lighting control of the light source unit 503 can be performed by a circuit formed on the circuit substrate 515 inside the circuit casing 514. Accordingly, the LEDs 508 of the light source unit 503 and the various electronic components (not shown) on the circuit substrate 515 can generate heat. If no countermeasure is taken, the light source unit 503 and the circuit substrate 515 become overheated and increase in temperature excessively.

In the present exemplary embodiment, at the same time when the LED s 508 are activated, the liquid-cooling heat dissipation system 505 can be activated. Accordingly, the light source unit 503 and the circuit casing 514 serving as the heat sink of the air-cooling heat dissipation system 504 can be forceably cooled by the cooling liquid circulating within the circulation path as shown in FIG. 30. This can decrease the temperature of the device. The heat generated from the light source unit 503 and the circuit substrate 515 can be transferred to the circuit casing 514 and is dissipated from the surface of the circuit casing 514 and the plurality of heat dissipation pins 517 that constitute the air-cooling heat dissipation system 504. The heat dissipation can be facilitated by the cooling wind flowing from the inlet ports 506 toward the discharge ports 507 within the housing 502 by the fan 522.

In the liquid-cooling heat dissipation system 505, the cooling liquid circulating through the circulation path by the circulation pump 523 can receive the heat generated by the light source unit 503 and the circuit substrate 515 when passing through the heat receiving jacket 520. The cooling liquid, increased in temperature due to reception of the heat, can be introduced into the radiator 521 through the tube 529.

When the fan 522 is driven to rotate by a motor (not shown), outside air can be introduced into the housing 502 as cooling wind flowing from the inlet ports 506 formed on the peripheral surface of the housing 502. The cooling wind can flow in the space S formed between the heat receiving jacket 520 and the radiator 521 upward. The air passing through the radiator 521 can be discharged from the discharge ports 507 formed on the surface of the housing 502 to the outside. In the radiator 521, the heat of the cooling liquid can be dissipated to the outside through the cooling wind passing through the radiator 521. The cooling liquid decreased in temperature can be sucked by the circulation pump 523 through the tube 532.

The cooling liquid sucked by the circulation pump 523 can be pressurized and fed to the reserve tank 524 by the circulation pump 523 through the tube 533. Part of the cooling liquid can be stored in the reserve tank 524, and the remainder thereof can be fed from the reserve tank 524 to the heat receiving jacket 520 via the tube 534, thereby cooling the light source unit 503, the circuit casing 514 and the inside circuit substrate 515 again. The above action (cooling cycle) can be continuously repeated so that the cooling liquid flowing through the heat receiving jacket 520 can forcedly cool the light source unit 503, the circuit casing 514 and the circuit substrate 515. Accordingly, their temperature rise is suppressed to a predetermined temperature or lower.

In the present exemplary embodiment, the air-cooling heat dissipation system 504 (including the circuit casing 514) and the light source unit 503 can be disposed so that the heat receiving jacket 520 is interposed therebetween. When the circulation pump 523 is activated to circulate the cooling liquid through the closed circulation path, the light source unit 503, the circuit casing 514 and the circuit substrate 515 can be forcedly cooled simultaneously by the cooling liquid in the heat receiving jacket 520, which is interposed therebetween. When the liquid-cooled LED lighting device 501 is used in a dangerous area, the liquid-cooling heat dissipation system 505 can suppress the maximum temperature of the light emission portion of the light source unit 503 to lower than the flash point of the surrounding flammable gas (for example, in the present exemplary embodiment, 95° C. or lower).

In addition to this, the present exemplary embodiment is configured such that the air-cooling heat dissipation system 504 can effectively absorb heat generated by the LEDs 508 of the light source unit 503 in addition to the liquid-cooling heat dissipation system 505. Accordingly, the maximum temperature of the light emission portion of the light source unit 503 can be effectively suppressed to lower than the flash point of the surrounding flammable gas. Even when the liquid-cooled LED lighting device 501 is used in a dangerous area, it is possible to prevent possible explosion risks.

In the present exemplary embodiment, the lower surface of the circuit casing 514 is in close contact with the heat receiving jacket 520, and the plurality of heat dissipation pins 517 are protrudingly formed on the upper surface of the circuit casing 514. This means the LED lighting device 501 is provided with the air-cooling heat dissipation system 504 in addition to the liquid-cooling heat dissipation system 505. Accordingly, the heat generated by the LEDs 508 of the light source unit 503 can be effectively dissipated. Therefore, the maximum temperature of the light emission portion of the light source unit 503 can be effectively suppressed to lower than the flash point of the surrounding flammable gas. Even when the liquid-cooled LED lighting device 501 is used in a dangerous area, it is possible to prevent possible explosion risks.

The liquid-cooled LED lighting device 501 of the presently disclosed subject matter utilizes as its light source the LEDs 508 that are substantially maintenance free. Accordingly, the replacement of light sources can be eliminated, thereby facilitating ease of maintenance.

In the present exemplary embodiment, the light source unit 503 can be entirely in closed contact with the lower surface of the heat receiving jacket 520, with the heat conductive sheet 527 which has high heat conductivity. This means the entire surface of the light source unit 503 can serve as a heat transmission surface, thereby facilitating the effective cooling of the light source unit 503 by the cooling liquid through the heat receiving jacket 520. It should be noted that the entire surface of the light source unit 503 can be maintained in close contact with the heat receiving jacket 520 through the use of the heat conductive sheet 527. Without the heat conductive sheet 527, the light source unit 503 can partly contact the heat receiving jacket 520 in practice, thereby making it impossible to enhance its cooling effects. If an attempt was made to place the entire surface of the light source unit 503 in close contact with the heat receiving jacket 520 without the use of the heat conductive sheet 527, then, the contacting surface of the heat receiving jacket 520 should be subjected to a smoothening treatment, such as a polishing process to render it as smooth as the metal base 510 of the light source unit 503. However, this disadvantageously increases the processing steps, man hours, and costs.

Furthermore, in the present exemplary embodiment, the air-cooling heat dissipation system 504 is disposed in the space S formed between the heat receiving jacket 520 and the radiator 521 of the liquid-cooling heat dissipation system 505. When cooling wind is introduced into the housing 502 by the fan 522, it can forceably cool the circuit casing 514 and the circuit substrate 515. In addition to the forced cooling by the cooling liquid, the circuit casing 514 and the circuit substrate 515 can be cooled more effectively, thereby suppressing the increase in temperature effectively and sufficiently.

In the liquid-cooled LED lighting device 501 according to the presently disclosed subject matter, when the liquid-cooling heat dissipation system 505 having operating portions such as the fan 522 and the circulation pump 523 cannot work properly due to some accident (namely, the cooling function is damaged), the current to be supplied to the LEDs 508 of the light source unit 503 can be controlled to a value such that heat generated by the LEDs 508 can be absorbed by the air-cooling heat dissipation system 504.

Accordingly, if the liquid-cooling heat dissipation system 505 is broken and the cooling function cannot work, the current to be supplied to the LEDs 508 of the light source unit 503 can be reduced. This control can suppress the heat generated by the LEDs 508 to the heat amount that can be absorbed by the air-cooling heat dissipation system 504, i.e., the heat that can be sufficiently dissipated from the circuit casing 514 and the heat dissipation pins 517, thereby preventing overheating of the LEDs 508. In this case, although the illumination intensity from the LED lighting device 501 may be lowered due to the suppressed current, the maximum temperature of the light source unit 503 can be controlled to be lower than the flash point of the surrounding flammable gas. Thus, even if the liquid-cooled LED lighting device 501 of the presently disclosed subject matter is used in a dangerous area, it is possible to prevent explosion risks. Namely, if the LED lighting device 501 is used in a gas station or a chemical plant where dangerous works are carried out, accidental light-off can be prevented, thereby ensuring high safety in such dangerous areas.

Figure 31:
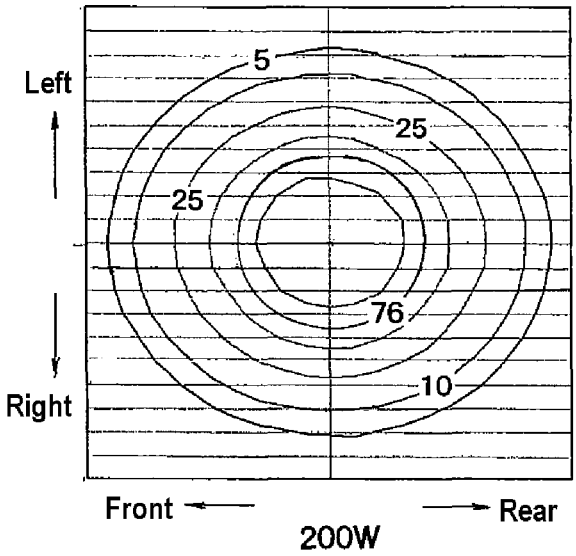
FIG. 31 is a graph showing the illumination intensity distribution when the LED lighting device is driven with an output of 200 W.

In the liquid-cooled LED lighting device 501 of the present exemplary embodiment, when the air-cooling heat dissipation system 504 and the liquid-cooling heat dissipation system 505 are properly operated, the output with which the junction temperature of the LED does not exceed 100° C. is 200 W. FIG. 31 shows the illumination intensity distribution when the LED lighting device is driven with an output of 200 W. As shown in FIG. 31, the LED lighting device 501 can illuminate an area of approximately 8 m square with an illumination intensity of 5 1× or more. It should be noted that the illumination intensity was observed when the LED lighting device was installed at a height of 6 m (the same condition is applied to the cases of FIGS. 32 and 33). In the graph, the vertical axis is the distance in the right-to-left direction on the ground and the horizontal axis is the distance in the front-to-rear direction on the ground (unit: meter), and the numeral indicated in the graph is the illumination intensity (unit: 1×). (The same is applied to the cases of FIGS. 32 and 33).

Figure 32:
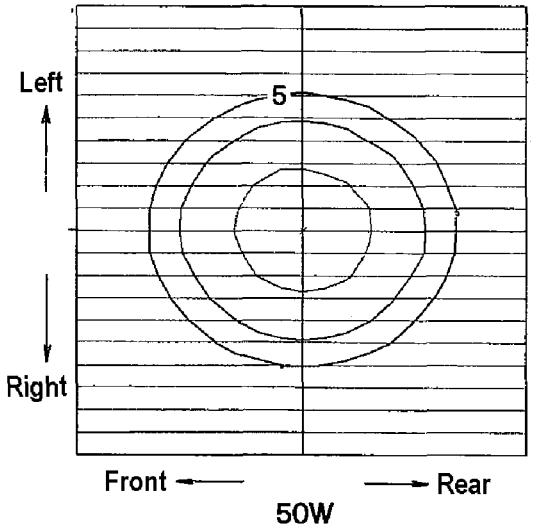
FIG. 32 is a graph showing the illumination intensity distribution when the LED lighting device is driven with an output of 50 W.

If the liquid-cooling heat dissipation system 505 is broken and the cooling function cannot work, the current to be supplied to the LEDs 508 of the light source unit 503 can be reduced. For example, the output can be suppressed to 50 W that is one-fourth of the normal output of 200 W. In this case, the illumination intensity is lowered, but the function as a lighting device is not damaged and it is possible to prevent possible explosion risks due to the surrounding flammable gases. FIG. 32 shows the illumination intensity distribution when the LED lighting device is driven with an output of 50 W. As shown in FIG. 32, the LED lighting device 501 can illuminate an area of approximately 6 m square with an illumination intensity of 5 1× or more.

Figure 33:
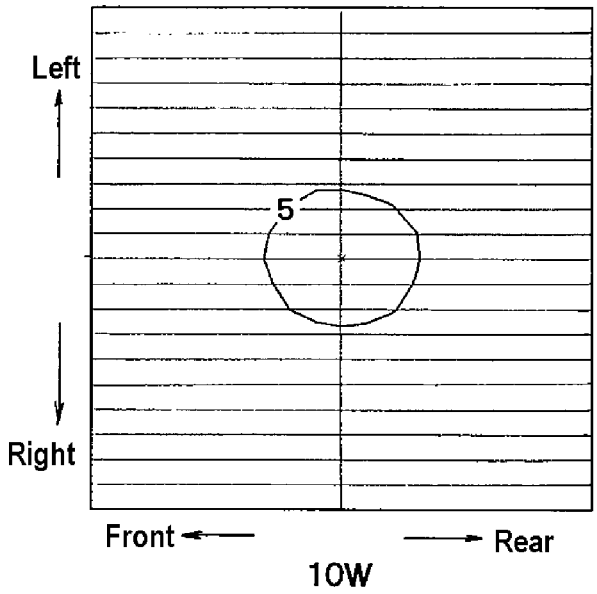
FIG. 33 is a graph showing the illumination intensity distribution when the LED lighting device is driven with an output of 10 W.

Suppose that when the LED lighting device does not have the air cooling unit 504, but only includes a liquid-cooling heat dissipation system 505, and the liquid-cooling heat dissipation system 505 is broken. In this case, cooling is achieved only by natural heat dissipation from the surface of the heat receiving jacket 520. In addition, in such a case, the output when the junction temperature of the LED does not exceed 100° C. is 10 W, that is, one-twentieth of the normal output of 200 W. FIG. 33 shows the illumination intensity distribution when the LED lighting device is driven with an output of 10 W. As shown in FIG. 33, the LED lighting device can illuminate an area of approximately 3 m square with an illumination intensity of 5 1× or more.

A description will be given of another exemplary embodiment of the presently disclosed subject matter with reference to FIGS. 34 and 35.

Figure 34:
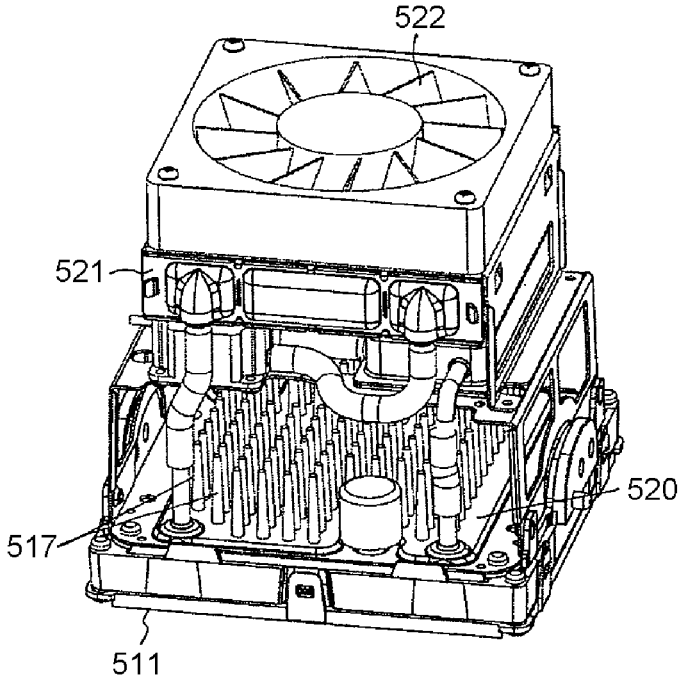
FIG. 34 is a perspective view of a liquid-cooled LED lighting device according to another exemplary embodiment of the presently disclosed subject matter when a housing is removed.
Figure 35:
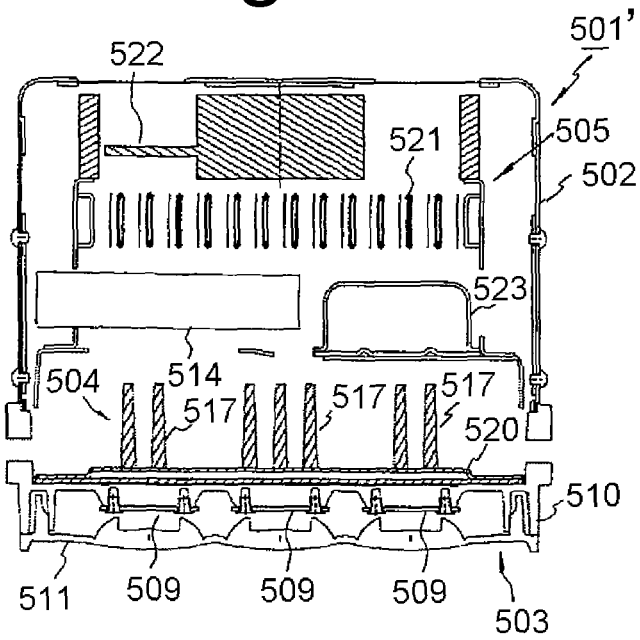
FIG. 35 is a longitudinal cross-sectional view illustrating the liquid-cooled LED lighting device according to an exemplary embodiment of the presently disclosed subject matter.

FIG. 34 is a perspective view of a liquid-cooled LED lighting device of the presently disclosed subject matter when a housing is removed, and FIG. 35 is a longitudinal cross-sectional view of the liquid-cooled LED lighting device.

The liquid-cooled LED lighting device 501' of the present exemplary embodiment can be used in dangerous areas. In the device 501', the heat sink for the air-cooling heat dissipation system 504 can include a plurality of heat dissipation pins 517 formed in the heat receiving jacket 520. The other configuration is the same as the LED lighting device 501 of the previous exemplary embodiment. Accordingly, the same or similar components in FIGS. 34 and 35 are denoted by the same reference numerals as those in FIGS. 23 to 30, and descriptions thereof will be omitted hereinafter.

Also in the present exemplary embodiment, the air-cooling heat dissipation system 504 and the liquid-cooling heat dissipation system 505 can suppress the maximum temperature of the light emission portion of the light source unit 503 to lower than the flash point of a surrounding flammable gas (for example, in the present exemplary embodiment, 95° C. or lower).

Furthermore, when the liquid-cooling heat dissipation system 505 having operating portions, such as a fan 522 and a circulation pump 523, cannot work properly due to some accidents (namely, the cooling function of the system 505 is damaged), the current to be supplied to the LEDs 508 of the light source unit 503 can be controlled to a value such that heat generated by the LEDs can be absorbed by the air-cooling heat dissipation system 504.

Accordingly, the present exemplary embodiment is configured such that the air-cooling heat dissipation system 504 can effectively absorb heat generated by the LEDs 508 of the light source unit 503 in addition to the liquid-cooling heat dissipation system 505. By doing so, the maximum temperature of the light emission portion of the light source unit 503 can be effectively suppressed to lower than the flash point of the surrounding flammable gas. Even when the liquid-cooled LED lighting device 501' is used in a dangerous area, it is possible to prevent possible explosion risks.

When the liquid-cooling heat dissipation system 505 cannot work properly due to some accidents and the cooling function thereof is damaged, the current supplied to the LEDs 508 of the light source unit 503 can be controlled to a value such that heat generated by the LEDs 508 can be absorbed by the air-cooling heat dissipation system 504. Namely, this control can suppress the heat generated by the LEDs 508 to the heat amount that can be absorbed by the heat receiving jacket 520 and the heat dissipation pins 517, thereby preventing overheating of the LEDs 508. Although the illumination intensity from the LED lighting device 501' may be lowered due to the suppressed current, the function as a lighting device is not damaged and it is possible to prevent the possible explosion risk due to the surrounding flammable gases as in the previous exemplary embodiment.

In the present exemplary embodiment, the heat dissipation pins 517 are formed in the heat receiving jacket 520. However, the presently disclosed subject matter is not limited to this, and heat dissipation fins may be formed in the heat receiving jacket 520 instead of the heat dissipation pins 517. The heat dissipation pins 517 and/or the heat dissipation fins can be integrally formed with the heat receiving jacket 520. Alternatively, separate heat dissipation pins 517 and/or separate heat dissipation fins can be fixed to the heat receiving jacket 520 by soldering, calking, screwing or the like. When separate heat dissipation pins or fins are fixed to the heat receiving jacket 520 by soldering or the like, the pins and/or fins can be formed of thin metal springs or thin metal bellows. The shape of the atmospheric heat dissipation portion can be the same shape as those generally used for heat sink.

The liquid-cooled LED lighting device of the presently disclosed subject matter can be used as exterior lighting devices such as street lamps, garden lamps, and various sports arena lighting devices.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A liquid-cooled LED lighting device comprising:

an LED light source;

a liquid cooling system including a heat receiving jacket and a radiator;

an LED light source-driving power supply configured to supply power to the LED light source;

a liquid cooling system-driving power supply configured to supply power to the liquid cooling system; and a control unit configured to control at least one of the LED light source-driving power supply and the liquid cooling system-driving power supply, wherein the control unit is configured to maintain a supply of the power from the liquid cooling system-driving power supply to the liquid cooling system for a predetermined period of time after supply of power from the LED light source-driving power supply to the LED light source is stopped.

2. The liquid-cooled LED lighting device according to claim 1, further comprising an LED on-off switch configured to transmit an ON signal and an OFF signal to the control unit, wherein the control unit includes a timer circuit configured to be activated in response to the OFF signal transmitted from the LED on-off switch, and wherein the control unit is configured to maintain the supply of the power from the liquid cooling system-driving power supply to the liquid cooling system for a predetermined time in response to an output signal from the timer circuit.

3. The liquid-cooled LED lighting device according to claim 1, wherein the control unit includes a temperature control circuit including a temperature detection element that is secured to one of the LED light source, the heat receiving jacket, and a metal base in contact with the heat receiving jacket, and wherein the control unit is configured to control a drive current for the LED light source based on a temperature detected by the temperature detection element.

4. The liquid-cooled LED lighting device according to claim 3, wherein the temperature detection element is at least one of a thermistor and a temperature detection IC.

5. The liquid-cooled LED lighting device according to claim 3, wherein the control unit is configured to control the drive current for the LED light source to be within a range of from zero (0) to a normal LED drive current.

6. The liquid-cooled LED lighting device according to claim 5, wherein the temperature detection element is at least one of a thermistor and a temperature detection IC.

7. The liquid-cooled LED lighting device according to claim 1, wherein the control unit includes a temperature control circuit including a temperature detection element that is secured to one of the LED light source, the heat receiving jacket, and a metal base in contact with the heat receiving jacket, and wherein the control unit is configured to maintain the supply of the power from the liquid cooling system-driving power supply to the liquid cooling system for a period of time in response to an output signal from the temperature control circuit.

8. The liquid-cooled LED lighting device according to claim 7, wherein the temperature detection element is at least one of a thermistor and a temperature detection IC.

9. The liquid-cooled LED lighting device according to claim 7, wherein if a temperature detected by the temperature detection element at a time when the supply of the power from the LED light source-driving power supply to the LED light source is started is lower than a second predetermined threshold value, the control unit is configured to then prevent the supply of the power from the liquid cooling system-driving power supply to the liquid cooling system until the temperature detected by the temperature detection element is equal to or higher than the second predetermined threshold value.

10. The liquid-cooled LED lighting device according to claim 9, wherein the temperature detection element is at least one of a thermistor and a temperature detection IC.

11. The liquid-cooled LED lighting device according to claim 7, wherein when a temperature detected by the temperature detection element after the supply of the power from the LED light source-driving power supply to the LED light source is stopped is higher than a first predetermined threshold value, the control unit is configured to then maintain the supply of the power from the liquid cooling system-driving power supply to the liquid cooling system until the temperature detected by the temperature detection element is equal to or lower than the first predetermined threshold value.

12. The liquid-cooled LED lighting device according to claim 11, wherein the temperature detection element is at least one of a thermistor and a temperature detection IC.

13. The liquid-cooled LED lighting device according to claim 11, wherein if a temperature detected by the temperature detection element at a time when the supply of the power from the LED light source-driving power supply to the LED light source is started is lower than a second predetermined threshold value, the control unit is configured to then prevent the supply of the power from the liquid cooling system-driving power supply to the liquid cooling system until the temperature detected by the temperature detection element is equal to or higher than the second predetermined threshold value.

14. The liquid-cooled LED lighting device according to claim 13, wherein the temperature detection element is at least one of a thermistor and a temperature detection IC.

15. A liquid-cooled LED lighting device comprising an LED light source;

a liquid cooling system including a heat receiving jacket and a radiator;

an LED light source-driving power supply configured to supply power to the LED light source;

a liquid cooling system-driving power supply configured to supply power to the liquid cooling system;

a control unit configured to control at least one of the LED light source-driving power supply and the liquid cooling system-driving power supply; and a temperature detection element, the temperature detection element secured to the LED light source to detect a temperature of the LED light source, wherein the liquid-cooled LED lighting device is configured to illuminate an area where a flammable gas having a flash point is present, and wherein the control unit is configured to control at least one of the LED light source-driving power supply and the liquid cooling system-driving power supply to maintain the temperature of the LED light source to be lower than the flash point of the flammable gas.

16. The liquid-cooled LED lighting device according to claim 15, wherein the temperature detection element is at least one of a thermistor and a temperature detection IC.

17. The liquid-cooled LED lighting device according to claim 15, further comprising an air cooling heat dissipation system, and wherein when the liquid cooling system does not work properly, the control unit is configured to then control the LED light source-driving power supply so that the detected temperature of the LED light source is maintained to be lower than the flash point of the flammable gas only by the air cooling heat dissipation system.

* * * * *